US010352327B2

(12) United States Patent
Ohfuji et al.

(10) Patent No.: US 10,352,327 B2
(45) Date of Patent: Jul. 16, 2019

(54) VACUUM PUMP

(75) Inventors: Masaki Ohfuji, Nagaokakyo (JP); Toshifumi Hashimoto, Kyoto (JP); Shingo Tanaka, Kyoto (JP)

(73) Assignee: SHIMADZU CORPORATION, Kyoto-shi (JP)

( * ) Notice: Subject to any disclaimer, the term of this patent is extended or adjusted under 35 U.S.C. 154(b) by 1471 days.

(21) Appl. No.: 13/882,413

(22) PCT Filed: Dec. 19, 2011

(86) PCT No.: PCT/JP2011/079391

§ 371 (c)(1),
(2), (4) Date: Apr. 29, 2013

(87) PCT Pub. No.: WO2012/081726

PCT Pub. Date: Jun. 21, 2012

(65) Prior Publication Data

US 2013/0224042 A1 Aug. 29, 2013

(30) Foreign Application Priority Data

Dec. 17, 2010 (JP) ..... 2010-281909

(51) Int. Cl.
*F04D 19/04* (2006.01)
*F04D 27/00* (2006.01)
(Continued)

(52) U.S. Cl.
CPC ..... *F04D 27/0292* (2013.01); *F04D 19/042* (2013.01); *F04D 19/048* (2013.01); *F04D 27/001* (2013.01); *F04D 29/644* (2013.01)

(58) Field of Classification Search
CPC .. F04D 27/0292; F04D 27/001; F04D 19/048; F04D 29/644; F04D 19/042;
(Continued)

(56) References Cited

U.S. PATENT DOCUMENTS

2003/0021673 A1 1/2003 Maejima et al.
2008/0131288 A1* 6/2008 Kozaki ..... 417/32
2010/0300325 A1* 12/2010 Iden ..... 105/238.1

FOREIGN PATENT DOCUMENTS

DE 10 2008 019 451 A1 10/2009
GB 2 422 233 A 7/2006
(Continued)

OTHER PUBLICATIONS

Extended European Search Report dated Mar. 13, 2014, issued in corresponding European Patent Application No. 11849180.2 (5 pages).
(Continued)

*Primary Examiner* — Bryan M Lettman
(74) *Attorney, Agent, or Firm* — Wasterman, Hattori, Daniels & Adrian, LLP

(57) ABSTRACT

A vacuum pump includes: a rotor that is rotated to perform evacuation; a pump disassembly detection circuit that detects a disassembled state in which the vacuum pump is disassembled; and a pump operation prohibition circuit that prohibits rotary drive of the rotor when the pump operation prohibition circuit determines that the pump disassembly detection circuit has detected the disassembled state.

5 Claims, 19 Drawing Sheets

(51) Int. Cl.
*F04D 27/02* (2006.01)
*F04D 29/64* (2006.01)

(58) Field of Classification Search
CPC ..... F04D 19/04; F04D 27/008; F04D 29/601; F04D 29/60
See application file for complete search history.

(56) References Cited

FOREIGN PATENT DOCUMENTS

| | | | | | |
|---|---|---|---|---|---|
| GB | 2422233 | | * | 7/2006 | ..... G06K 7/00 |
| JP | 11-338355 | A | | 12/1999 | |
| JP | 2000-99404 | A | | 4/2000 | |
| JP | 2002-229682 | A | | 8/2002 | |
| JP | 2003-21093 | A | | 1/2003 | |
| JP | 2003-148384 | A | | 5/2003 | |
| JP | 2005-273657 | A | | 10/2005 | |
| JP | 2007-128199 | A | | 5/2007 | |
| JP | 2008-38844 | A | | 2/2008 | |
| WO | 2009/127483 | A1 | | 10/2009 | |

OTHER PUBLICATIONS

International Search Report for PCT/JP2011/079391, dated Mar. 19, 2012.

Chinese Office Action dated Mar. 31, 2015, issued in corresponding CN Patent Application No. 201180060880.6 with English translation (13 pages).

* cited by examiner (a)

FIG.14

| | | INPUT SIGNAL b | |
|---|---|---|---|
| | | 0 | 1 |
| INPUT SIGNAL a | 0 | Q=(HOLD PREVIOUS STATE) | Q = 0 |
| | 1 | Q = 1 | Q=(HOLD PREVIOUS STATE) |

(a)

| | | PRESENT STATE Q(n) | |
|---|---|---|---|
| | | 0 | 1 |
| INPUT SIGNAL ab | 00 | Q(n+1) = 0 | Q(n+1) = 1 |
| | 01 | Q(n+1) = 0 | Q(n+1) = 0 |
| | 11 | Q(n+1) = 0 | Q(n+1) = 1 |
| | 10 | Q(n+1) = 1 | Q(n+1) = 1 |

(b)

| | | INPUT SIGNAL C1C0 | | | |
|---|---|---|---|---|---|
| | | 00 | 01 | 11 | 10 |
| INPUT SIGNAL C3C2 | 00 | Q=0 | Q=0 | Q=0 | Q=0 |
| | 01 | Q=0 | Q=0 | Q=0 | Q=0 |
| | 11 | Q=0 | Q=0 | Q=0 | Q=0 |
| | 10 | Q=0 | Q=0 | Q=0 | Q=1 |

(b)

(a)

VACUUM PUMP

TECHNICAL FIELD

The present invention relates to a vacuum pump that detects disassembly of the pump.

BACKGROUND ART

In a turbomolecular pump, a rotor that is formed of turbine blades (rotary blades) rotates at high speeds with respect to fixed-side turbine blades (fixed blades) to exhaust gases. The fixed-side turbine blades and the rotor are arranged within a pump casing that is formed of an inlet flange (see Patent Literature 1).

Generally, when a turbomolecular pump is used, periodical maintenance and overhauling are required. For example, for turbomolecular pumps of the type supported by mechanical bearings, it is indispensable to periodically exchange the mechanical bearings. In turbomolecular pumps with magnetic bearings, mechanical bearing are used as touch-down bearings. In this case, it becomes sometimes necessary to exchange the bearings due to wear after prolonged use of the pumps. Furthermore, when a turbomolecular pump is used in an apparatus that discharges a corrosive gas, the product tends to stick to a gas flow channel in the pump to hinder the operation of the pump, so that it becomes necessary to perform maintenance for removing the product.

In operations of disassembly and assembly of a vacuum pump, no special instruments are needed, so that maintenance of the pump may be entrusted to a dealer other than the manufacturer of the pump and a designated dealer, or the maintenance may be performed by the user himself. However, for not only turbomolecular pumps but also vacuum pumps, severe precisions are required when they are assembled in order to secure vacuum performance and safety. Therefore, maintenance of a vacuum pump which involves disassembly and assembly of the pump is performed by a trained expert operator, that is, by an operator from the manufacturer of the pump or an operator from the designated maintenance dealer.

CITATION LIST

Patent Literature

Patent Literature 1: Japanese Laid Open Patent Publication 2008-038844

SUMMARY OF INVENTION

Technical Problem

In the maintenance of a vacuum pump which involves operations of disassembly and assembly of the pump, there is the possibility that the maintenance is not appropriately performed if the maintenance is entrusted to a dealer other than the manufacturer of the pump and a designated dealer or if the user himself performs the maintenance. If the maintenance is performed inappropriately, not only the performance of the pump will be decreased and the service life of the pump will be shortened but also troubles will occur or safety will be harmed.

Solution to Problem

According to the first aspect of the present invention, a vacuum pump comprises: a rotor that is rotated to perform evacuation; a pump disassembly detection circuit that detects a disassembled state in which the vacuum pump is disassembled; and a pump operation prohibition circuit that prohibits rotary drive of the rotor when the pump operation prohibition circuit determines that the pump disassembly detection circuit has detected the disassembled state.

According to the second aspect of the present invention, in the vacuum pump according to the first aspect, it is preferred that the vacuum pump further comprises: a pump unit that includes the rotor and performs evacuation; and a control unit that performs drive control of the pump unit including the rotary drive of the rotor. It is preferred that the pump unit includes the pump disassembly detection circuit and a holding circuit that holds a state corresponding to a disassembly history when the pump disassembly detection circuit has detected the disassembled state, the control unit includes the pump operation prohibition circuit, and the pump operation prohibition circuit determines that in a case where the state corresponding to the disassembly history is held by the holding circuit at start-up of the control unit, the pump disassembly detection circuit has detected the disassembled state, and prohibits the drive control of the pump unit by the control unit.

According to the third aspect of the present invention, in the vacuum pump according to the second aspect, it is preferred that the control unit includes an input unit that inputs a cancel command for canceling the state corresponding to the disassembly history held by the holding circuit, and the pump unit includes a reset circuit that resets the state corresponding to the disassembly history held by the holding circuit when the cancel command is input therein by the control unit.

According to the fourth aspect of the present invention, in the vacuum pump according to the second aspect, it is preferred that the pump unit includes a magnetic bearing that magnetically levitates the rotor, the case where the state corresponding to the disassembly history is held by the holding circuit at start-up of the control unit is a case where other data that is different from a value of a magnetic bearing control parameter with which the magnetic bearing magnetically levitates the rotor is held by the holding circuit, the pump operation prohibition circuit determines that when the other data held by the holding circuit and the value of the magnetic bearing control parameter that is input into the control unit in advance do not coincide with each other, pump disassembly detection circuit has detected the disassembled state and prohibits the drive control of the pump unit by the control unit, and the holding circuit stores in advance the value of the magnetic bearing control parameter and replaces the value of the magnetic bearing control parameter that is stored in advance by the other data when the pump disassembly detection unit has detected the disassembled state.

According to the fifth aspect of the present invention, in the vacuum pump according to the first aspect, it is preferred that the vacuum pump further comprises: a pump unit that includes the rotor and performs evacuation; and a control unit that is separably fixed to the pump unit and performs drive control of the pump unit including the rotary drive of the rotor. It is preferred that the pump disassembly detection circuit detects the disassembled state when the control unit is separated from the pump unit.

According to the sixth aspect of the present invention, in the vacuum pump according to the fifth aspect, it is preferred that the pump unit and the control unit each include a connector that electrically connects the pump unit and the control unit with each other, and the pump disassembly detection circuit detects the disassembled state when the connector is separated upon separation of the control unit from the pump unit.

According to the seventh aspect of the present invention, in the vacuum pump according to any one of the first to the sixth aspects, it is preferred that the vacuum pump further comprises: an alarm device that generates an alarm when the pump operation prohibition circuit determines that the pump disassembly detection circuit has detected the disassembled state.

Advantageous Effect of Invention

According to the present invention, when the pump disassembly detection circuit has detected pump disassembly, the pump operation prohibition circuit prohibits the rotary drive of the rotor, so that the safety of the vacuum pump can be increased.

BRIEF DESCRIPTION OF DRAWINGS

FIG. 14 presents a diagram showing a truth table and a state transition table of the detection/holding circuit.

DESCRIPTION OF EMBODIMENTS

—First Embodiment—

Figure 1:
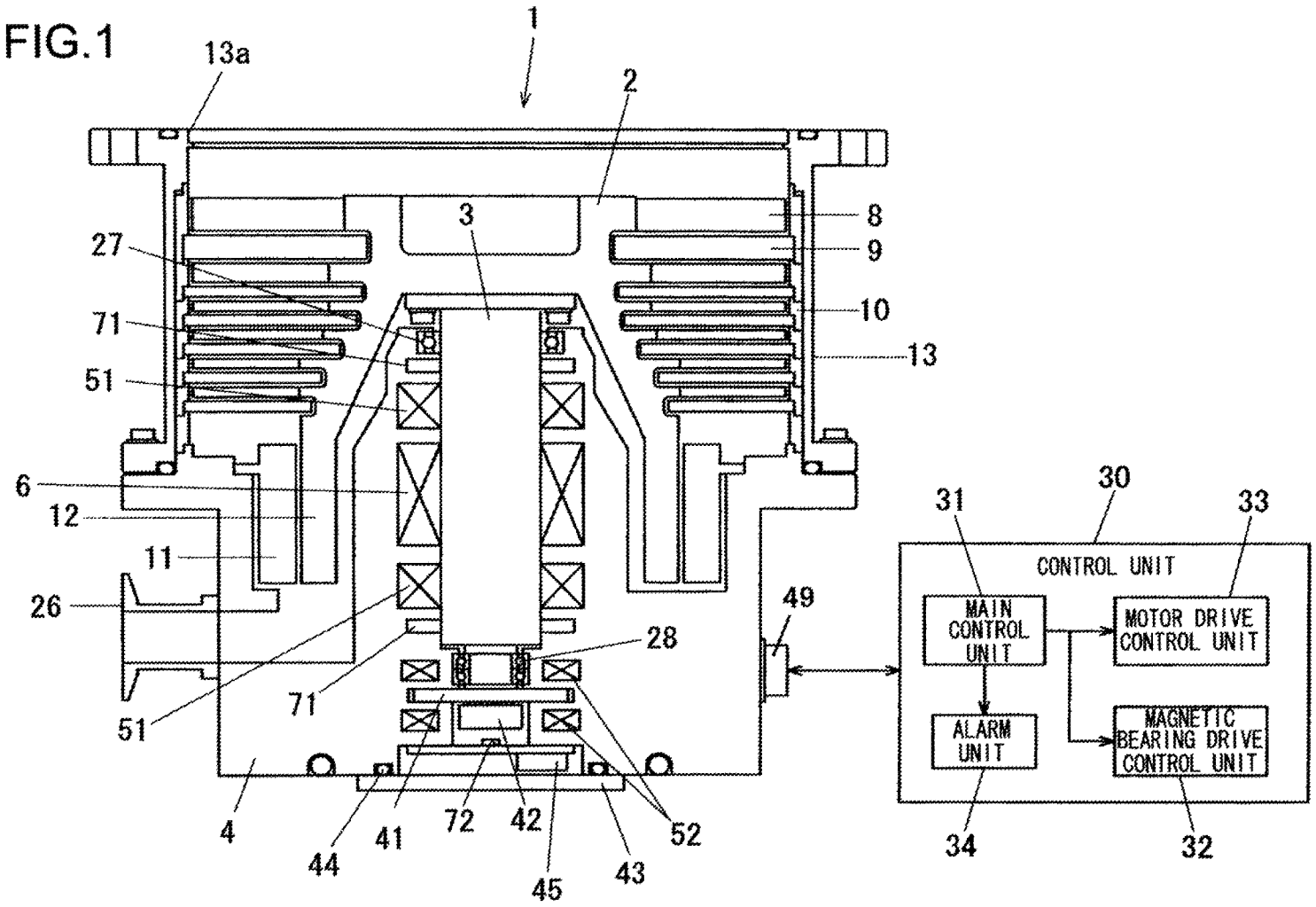
FIG. 1 presents a diagram showing a vacuum pump according to a first embodiment of the present application.

FIG. 1 presents a diagram showing a first embodiment of the vacuum pump and shows schematic configurations of a pump unit 1 and a control unit 30 of a turbomolecular pump which is of the magnetic bearing type. The descriptions "upper" and "lower" in the explanation of the pump unit 1 referring to FIG. 1 correspond to "upper" and "lower", respectively, when facing FIG. 1.

A shaft 3, to which a rotor 2 is attached, is contactlessly supported by electromagnet s 51, 52 provided on a base 4. The position of levitation of the shaft 3 is detected by a radial displacement sensor 71 and an axial displacement sensor 72, which sensors are provided on the base 4. The electromagnet 51 that constitutes a radial magnetic bearing and the electromagnet 52 that constitutes an axial magnetic bearing and the displacement sensors 71, 72 together constitute a five-axes-controlled magnetic bearing. That is, the five-axes-controlled magnetic bearing magnetically levitates the shaft 3 together with the rotor 2. Note that in a state where the magnetic bearing is not in operation, the shaft 3 is supported by mechanical bearings 27, 28.

At a lower end of the shaft 3, a circular disc 41 is provided and the electromagnets 52 are provided so that they sandwich the disc 41 from above and below. The disc 41 is attracted by each of the upper and lower electromagnets 52 so that the shaft 3 is levitated in the axial direction. The disc 41 is fixed at the lower end of the shaft 3 with a nut member 42. A disassembly detection unit 45 is provided on the side of the base 4. The disassembly detection unit 45 is described in detail later. A back lid 43, which is detached when the pump is disassembled, is fixed at the bottom of the base 4. The gap between the back lid 43 and the base 4 is hermetically sealed with an O-ring 44.

The rotor 2 is formed of a plurality of stages of rotary blades 8 in the direction of rotation axis. Between any adjacent two rotary blades 8 that are vertically arranged, a fixed blade 9 is disposed. The rotary blades 8 and the fixed blades 9 together constitute stages of turbine blades of the pump unit 1. Each of the fixed blades 9 is held by spacers such that it is sandwiched vertically by two spacers 10 from above and below. The spacers 10 have a function of holding the fixed blades 9 therebetween and a function of maintaining the gap between the adjacent fixed blades 9 at a predetermined distance.

A thread stator 11 that constitutes a drag pump stage is provided at a rear stage of the fixed blades 9 (shown at a lower part of the figure). A gap is formed between an inner peripheral surface of the thread stator 11 and a cylindrical part 12 of the rotor 2. The rotor 2 and the fixed blades 9 held by the spacers 10 are accommodated in a pump casing 13 that is formed of an inlet 13*a*. By contactlessly supporting the shaft 3 provided with the rotor 2 by the electromagnets 51, 52 and driving it by the motor 6 to rotate it, the gas on the side of the inlet 13*a* is exhausted to the side of the outlet 26 and is discharged by an auxiliary pump connected to the outlet 26.

The drive control of the pump unit 1 is controlled by a control unit 30 connected to a pump connector 49 provided at an outer peripheral surface of the base 4. The control unit 30 is provided with a main control unit 31 and in addition a magnetic bearing drive control unit 32 that performs drive control of a magnetic bearing and a motor drive control unit 33 that performs drive controls of the motor 6. As described later, a disassembly detection unit 45 is provided with a data storage unit that stores back-tip data including data necessary for pump operation such as control parameters and data on serial numbers for identifying pumps and so on. Based on the back-up data stored in the data storage unit, the main control unit 31 controls the magnetic bearing drive control unit 32 and the motor drive control unit 33 and so on to perform pump operations. An alarm unit 34 of the control unit 30 outputs an alarm when it is impossible to start up the pump. The alarm unit 34 is provided with a speaker that generates an alarm sound and a display device that displays an alarm and so on.

When overhauling the pump unit 1, bolts (not shown) that fix the back lid 43 is detached to detach the electromagnet 52 arranged on the side of the back lid for the control of thrust. Then, a nut member 42 that fixes the rotor disc 41 to the shaft 3 is detached and the rotor disc 41 is removed from the shaft 3. As a result, the rotating body including the rotor 2 and the shaft 3 can be removed from within the pump unit 1. For example, when a product that sticks to the rotor 2 is to be removed, the rotor 2 is detached from the shaft 3 before a removal operation can be performed. When reassembly is to be performed, the rotor 2 is attached to the shaft 3 and then balancing is performed, and the rotating body is attached within the pump unit 1 in the order contrary to the above-mentioned order. To perform such disassembly/assembly operations of the turbomolecular pump, specialized knowledge and skills are required, so that usually maintenance operations are performed by the manufacturer of the turbomolecular pump.

However, since no special instruments are needed for the operations for detaching the rotor 2 or the shaft 3 from within the pump unit 1, the user can readily perform the disassembly/assembly operations. When the user assembles the pump, it may occur that the balance of the rotating body will be lost or clearances between parts cannot be maintained. In such cases, the rotating body and the fixed portion may contact each other during the operation of the pump to cause malfunction of the pump, which raises a problem of safety. Thus, the turbomolecular pump according to an embodiment of the present invention is configured as follows. That is, as shown in FIG. 1, a disassembly detection unit 45 is provided within the pump unit 1, and it is configured such that once disassembly of the pump unit 1 is performed, no pump start-up action after reassembly is allowed unless a predetermined procedure is followed.

Figure 2:
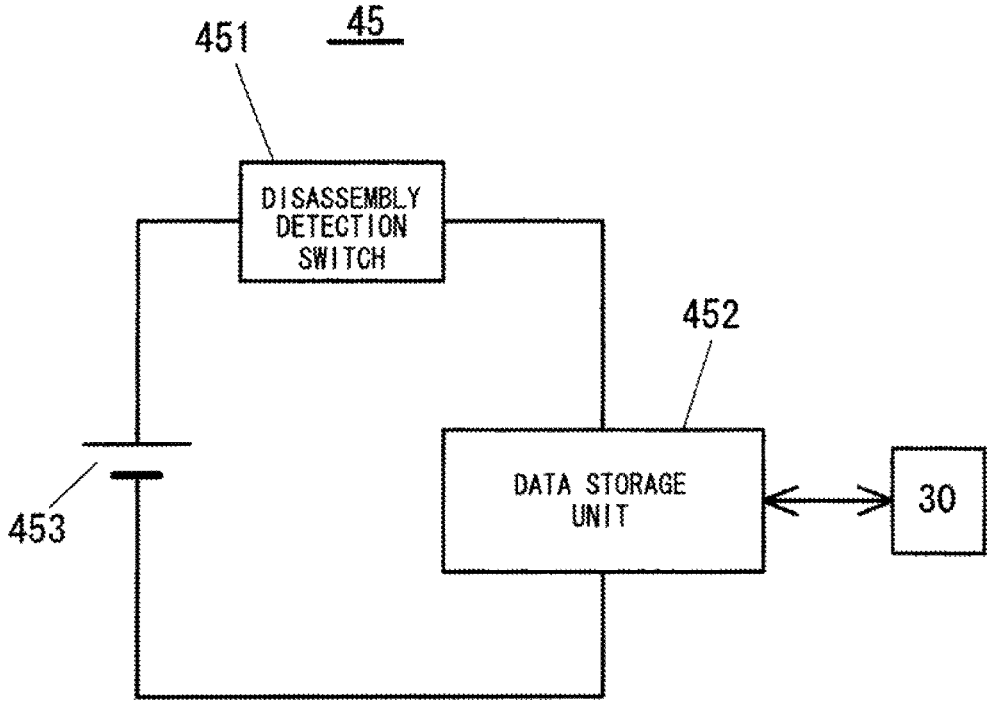
FIG. 2 presents a block diagram showing an example of a disassembly detection unit.

FIG. 2 presents a block diagram showing an example of a circuit that constitutes the disassembly detection unit 45 of the turbomolecular pump shown in FIG. 1. The disassembly detection unit 45 includes a disassembly detection switch 451, a data storage unit 452, and a power source 453 that functions as a voltage holding unit of the data storage unit 452. The disassembly detection switch 451 is a switch that operates such that when the pump is disassembled the circuit is brought into an open state and when the pump is assembled, the circuit is brought into a closed state. As the disassembly detection switch 451, for example, a mechanically acting automatic restoration contact is used.

The data storage unit 452 stores back-up data that includes data necessary for pump operations, such as control parameters. As the data storage unit 452, for example, SRAM or the like is used. The power source 453 is used as a power source for storing the back-up data. The main control unit 31 provided in the control unit 30 (see FIG. 1) performs pump operations based on the back-up data stored in the data storage unit 452. When the contact of the disassembly detection switch 451 is opened, a power supply to the data storage unit 452 is stopped, so that the back-up data stored in the data storage unit 452 is deleted.

Figure 3:
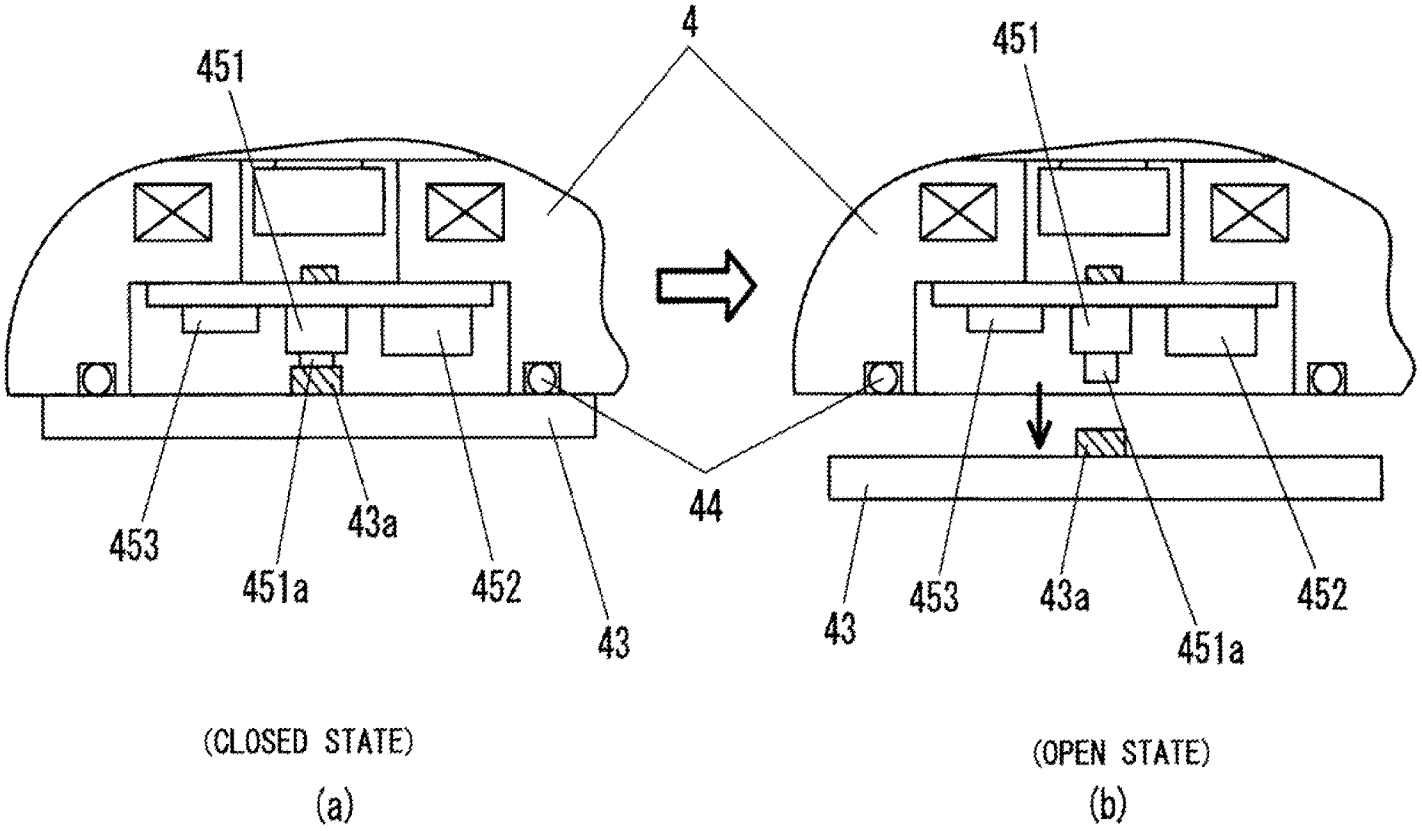
FIG. 3 presents a diagram showing a first example of a pump disassembly detection structure.
Figure 4:
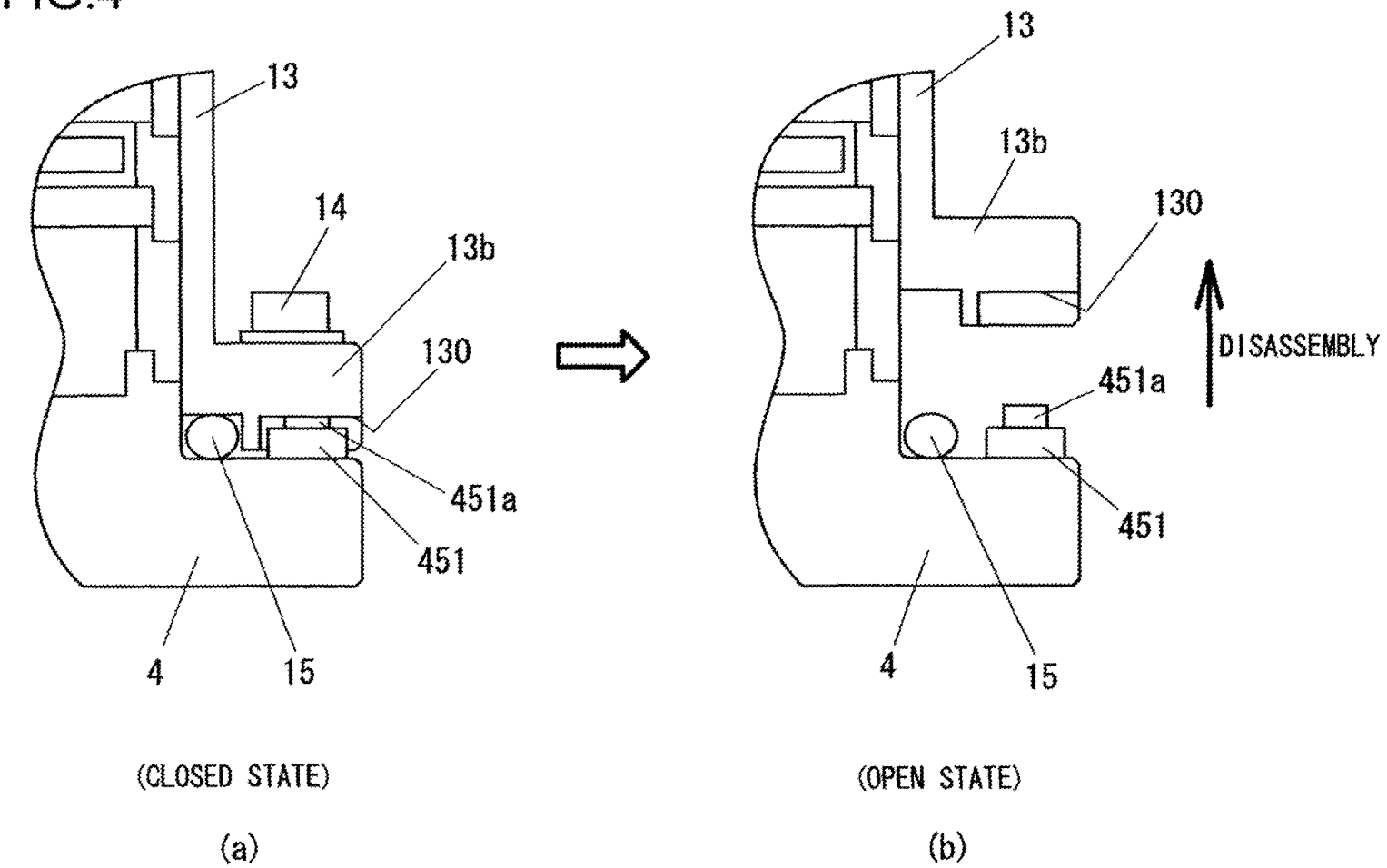
FIG. 4 presents a diagram showing a second example of the pump disassembly detection structure.

Examples of a structure that enables pump disassembly detection by the disassembly detection switch 451 include, for example, those structures shown in FIGS. 3 and 4, respectively. In the example shown in FIG. 3, the back lid 43 is fixed to the base 4 to form a space 4, in which parts that constitute the disassembly detection unit 45, that is, the disassembly detection switch 451, the power source 452, and the data storage unit 453 are accommodated. The disassembly detection switch 451 is provided with a push button 451*a*. On the side of an inner surface of the back lid 43, a convex portion 43*a* is formed in a position that faces the push button 451*a*, a convex portion 43*a* is formed at a position that faces the push button 451*a* of the disassembly detection switch 451. Therefore, when the back lid 43 is fixed to the base 4, the push button 451*a* of the assembly detection switch 451 is brought into a state pushed by the convex portion 43*a*.

Figure 5:
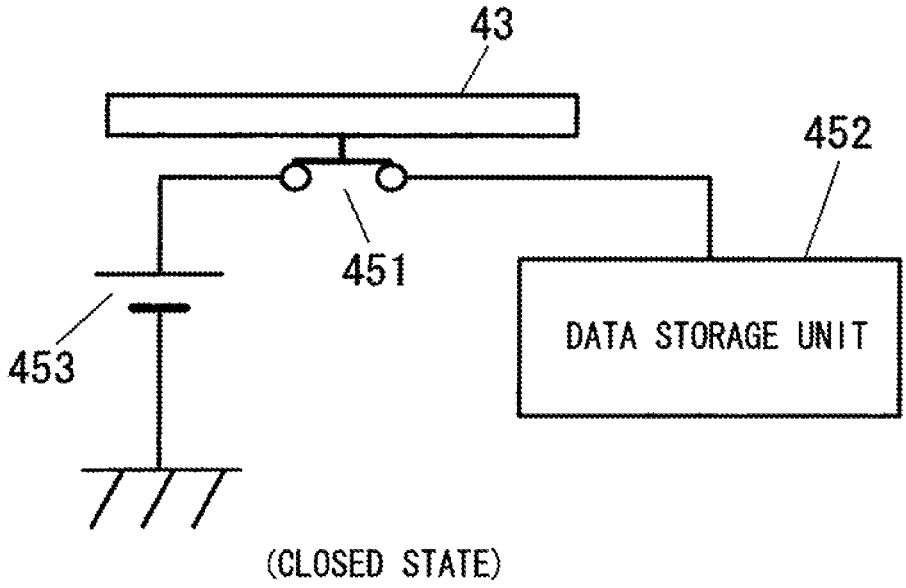
FIG. 5 presents a diagram illustrating operations of opening/closing a disassembly detection switch.
Figure 5:
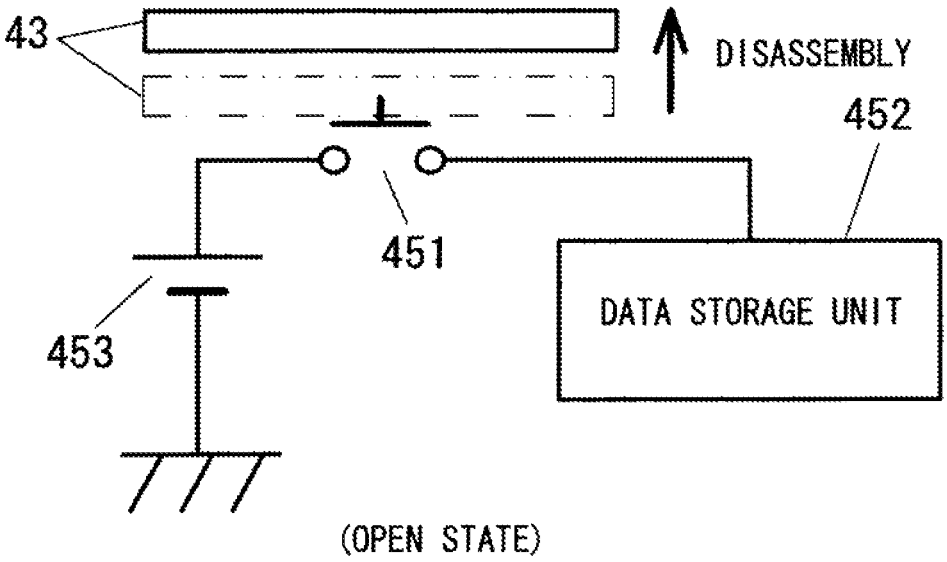

FIG. 5 presents a diagram that explains opening/closing operations of the disassembly detection switch 451. The disassembly detection switch 451 is a switch of a normally open type. As shown in FIG. 3(*a*), when the push button 451*a* is pushed by the convex portion 43*a* of the back lid 43, the contact of the disassembly detection switch 451 is closed as shown in FIG. 5(*a*). That is, the disassembly detection switch 451 is in a closed state, so that the state of disassembly of the turbomolecular pump is not detected. As a result, power is supplied from the power source 453 to the data storage unit 452 and the back-up data stored in the data storage unit 452 continues to be held.

On the other hand, when the back lid 43 is detached as shown in FIG. 3(*b*) for the pump maintenance operation, the convex portion 43*a* that is pushing the push button 451*a* is detached from the push button 451*a*. As a result, as shown in FIG. 5(*b*), the disassembly detection switch 451 is brought into an open state and the disassembled state of the turbomolecular pump is detected. The power supply from the power source 453 to the data storage unit 452 is discontinued, so that the back-up data stored in the data storage unit 452 is deleted.

When the rotor 2 is detached at the time of maintenance of the turbomolecular pump, the pump casing 13 is also detached from the base 4 (see FIG. 1). In the example of the configuration shown in FIG. 4, the disassembly detection switch 451 is arranged between a flange portion 13*b* of the pump casing 13 and the base 4. The disassembly detection switch 451 is installed on the base 4. The flange portion 13*b* is formed of a depression 130 in a region facing the disassembly detection switch 451.

As shown in FIG. 4(*a*), when the pump casing 13 is in a state of being fixed to the base 4, the push button 451*a* of the disassembly detection switch 451 is in a state of being pushed by the bottom of the depression 130. That is, the disassembly detection switch 451 is in a closed state and therefore the disassembled state of the turbomolecular pump is not detected. On the other hand, when the pump casing 13 is detached as shown in FIG. 4(*b*), the depression 130 that pushes the push button 451*a* is detached from the push button 451*a*. This results in that the disassembly detection switch 451 is brought into an open state so that the disassembled state of the turbomolecular pump is detected. Then, the power supply from the power source 453 to the data storage unit 452 is discontinued and the back-up data stored in the data storage unit 452 is deleted.

Figure 6:
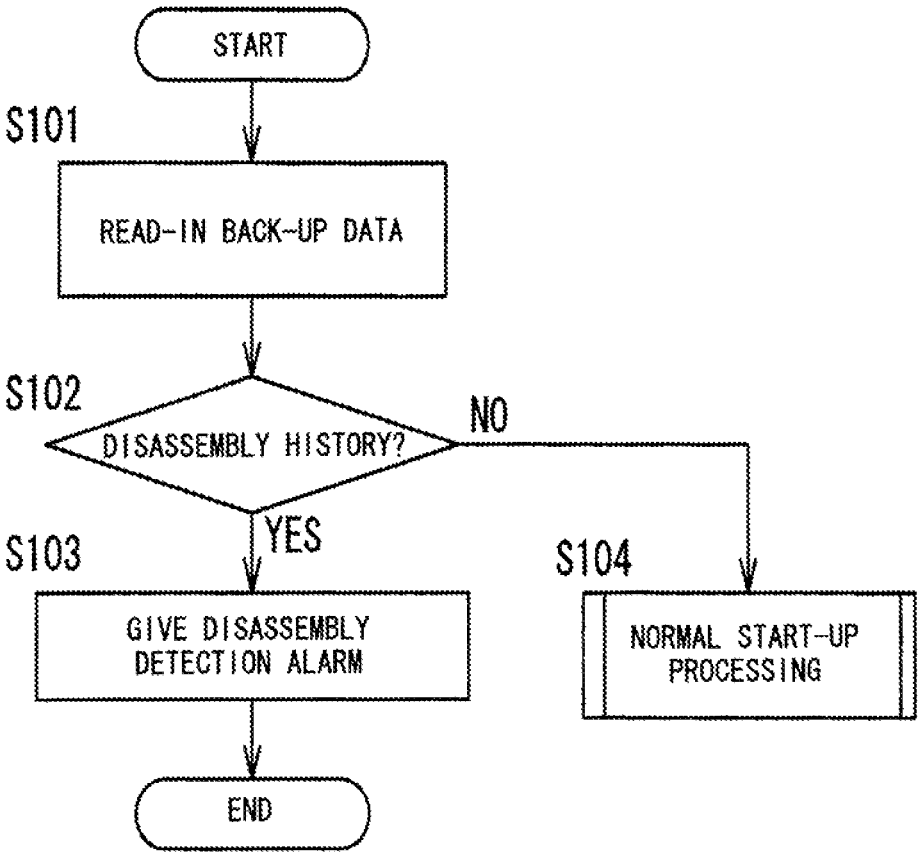
FIG. 6 presents a flowchart showing a control of disassembly history confirmation at start-up.

FIG. 6 presents a flowchart showing how the disassembly history confirmation of a turbomolecular pump of the type provided with the disassembly detection unit 45 described above is controlled. For example, when power is supplied to the control unit 30, a program relating to the processing shown in FIG. 6 is executed by the main control unit 31. In step S101, the main control unit 31 reads in the back-up data stored in the data storage unit 452.

In step S102, the main control unit 31 determines whether or not the pump 31 has been assembled or whether or not there is a disassembly history, based on the read-in back-up data. In the above-mentioned example, predetermined data for the recognition of disassembly as one of the control parameters is stored in advance both in the data storage unit 452 and in the memory of the main control unit 31. As shown in FIG. 5, the pump is configured such that the power supply from the power source 453 to the data storage unit is stopped due to the pump disassembly so that the back-up data stored by a memory element (SRAM) in the storage unit is deleted. That is, when there is a disassembly history, no back-up data is present in the data storage unit 452, so that the main control unit 31 reads in indefinite data that is held by the data storage unit 452. The indefinite data, which indicates that the state in which a disassembly history is present is held by the data storage unit 452, usually is not identical with the predetermined data for the recognition of disassembly stored in the memory of the main control unit 31. In step S102, the main control unit 31 determines whether or not the pump has been disassembled based on whether or not the data for the recognition of disassembly that is read in from the data storage unit 452 is identical with the data for the recognition of disassembly that is stored in the main control unit 31.

When the main control unit 31 determines that a disassembly history is present in step S102, it controls the process to proceed to step S103. That it is determined that a disassembly history is present means that it is determined that the disassembly detection switch 451 has detected the disassembled state of the turbomolecular pump. In this case, the main control unit 31 controls the pump so as not to perform a usual pump start-up action shown in step S104 but controls the alarm unit 34 to generate an alarm to notice that there has been pump disassembly as shown in step S103. The alarm unit 34 may generate the alarm to notice that there has been pump disassembly either by display or by sound. On the other hand, if the main control unit 31 determines that no disassembly history is present in step S102, it controls the process to proceed to step S104 to perform a normal pump start-up action. By performing such a control, when there has been non-normal pump disassembly by the user, the pump start-up action is prohibited, so that safety upon pump operation can be secured.

When there is a disassembly history and a start-up action is prohibited, the above-mentioned predetermined data for the recognition of disassembly is written into the data storage unit 452 after the assembled state of the pump was confirmed by the manufacturer of the pump. In this case, a dedicated data writing device and a personal computer (PC) having installed therein dedicated data writing software and so on are connected to the pump unit 1 through a dedicated cable to enable direct access to the data storage unit 452 to write in the predetermined data for the recognition of disassembly therein. The operation of writing the predetermined data for the recognition of disassembly in the storage unit 452 is an operation that can be done only by the manufacturer of the pump or a designated service company and how the writing in operation can be performed is not taught to the user. Therefore, the user cannot perform the writing in operation as he pleases.

Note that in the example of control shown in FIG. 6, predetermined data for the recognition of disassembly is stored both in the data storage unit 452 and in the memory of the main control unit 31 in advance and presence or absence of a disassembly history is determined by comparing the data stored, in the data storage unit 452 and the data stored in the memory of the main control unit 31 with each other. However, one of the control parameters used for pump operation can be used instead of the data for the recognition of disassembly. For example, the control parameters for magnetic bearing control by means of the five-axes-controlled magnetic bearing for magnetic levitation of the rotor 2 and the shaft 3 can also be used as data for the recognition of disassembly. In this case, if the control parameters are deleted due to the pump disassembly, normal magnetic levitation becomes impossible and the pump is automatically brought into a state where pump start-up is impossible. Therefore, even if the control shown in FIG. 6 is not adopted, the start-up of the pump can be prohibited when a non-normal pump disassembly has occurred. Also, control parameters relating to motor drive may be used. In this case, if the control parameters are deleted due to pump disassembly, it becomes impossible to drive the motor, the pump is automatically brought into a state where the start-up of the pump is impossible in the same manner as described above.

(Variation Example)

Figure 7:
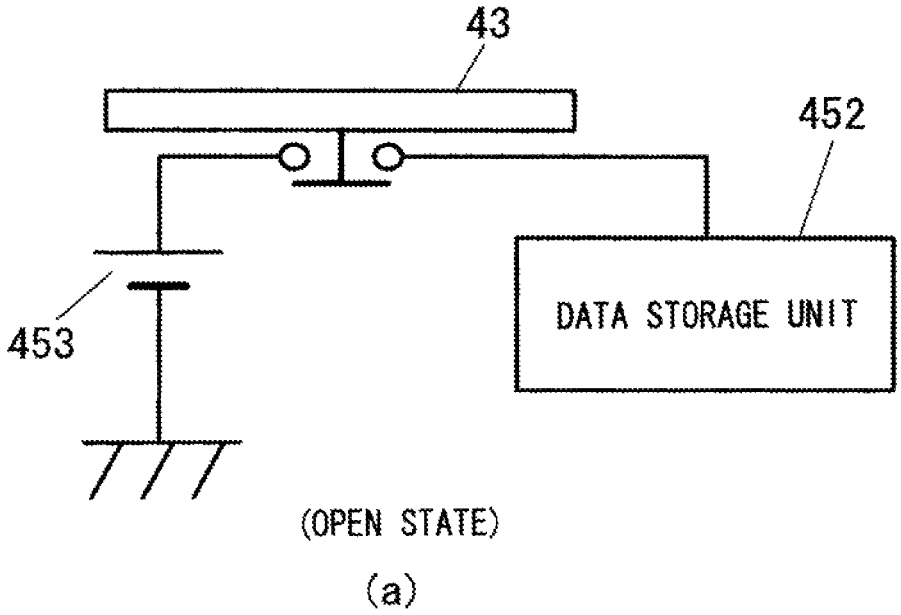
FIG. 7 presents a diagram illustrating actions of opening/closing a disassembly detection switch according to a variation example.
Figure 7:
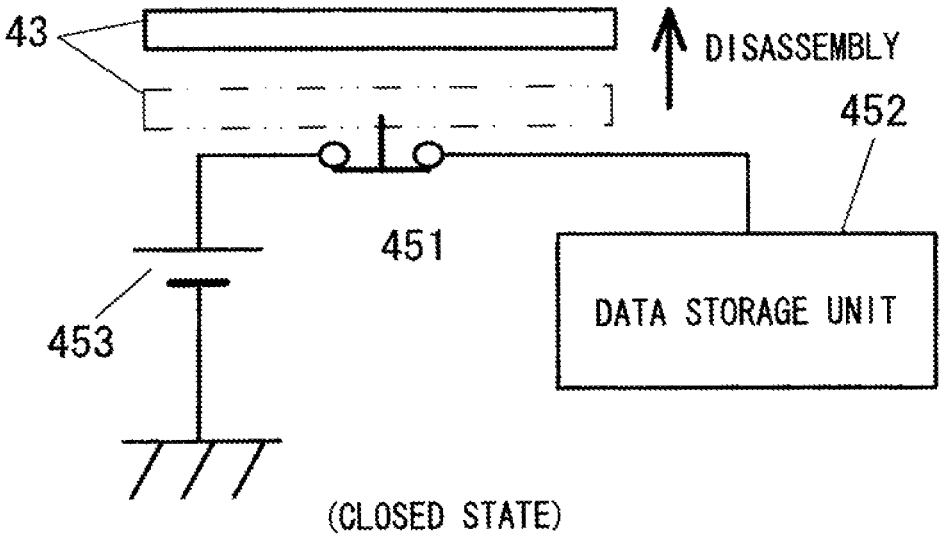

FIG. 7 presents a diagram showing a variation example of the above-mentioned embodiment, illustrating the action of the disassembly detection switch 451. In this variation example, the disassembly detection switch 451 is a switch of a normally closed type. When the pump is in an assembled state, the contact of the disassembly detection switch 451 is in an open state as shown in FIG. 7(*a*), and when the pump is in a disassembled state, the contact of the disassembly detection switch 451 is in a closed state as shown in FIG. 7(*b*).

In the configuration shown in FIG. 7, when the contact of the disassembly detection switch 451 is closed, fixed data is written in at a fixed address in the memory provided in the data storage unit 452 to change the data inside thereof. Alternatively, the memory of the data storage unit 452 may be configured to have a function to transfer the contents of the memory to a different address when the contact of the disassembly detection switch 451 is closed and write in dummy data at the original memory address.

Specifically, when the data storage unit has an SPI (Serial Peripheral Interface) memory element, the SPI is constituted by a clock, data, and chip select. The chip select is always enabled and the data line is kept in a state where fixed data can be transmitted therethrough, so that when the power is supplied, clock operates to introduce the data. The data storage unit 452 may be a CPU having a memory function, a CPU to which a memory is connected, or the like. In this case, the CPU may be provided with a function that when the power is supplied, the CPU is started up and deletes the contents of the memory according to the program in the CPU or a function that when the power is supplied, the CPU transfers the contents of the memory to a different address.

In FIG. 5, the main control unit 31 may directly detect the open/closed state of the disassembly detection switch 451 without arranging the data storage unit 452. In this case, the main control unit 31 determines that the disassembly detection switch 451 has detected the disassembled state of the turbomolecular pump when the main control unit 31 detects the open state of the disassembly detection switch 451 and the main control unit 31 will not perform a normal start-up action processing shown in step S104 in FIG. 6.

(Another Example of Disassembly Confirmation Control)

Figure 8:
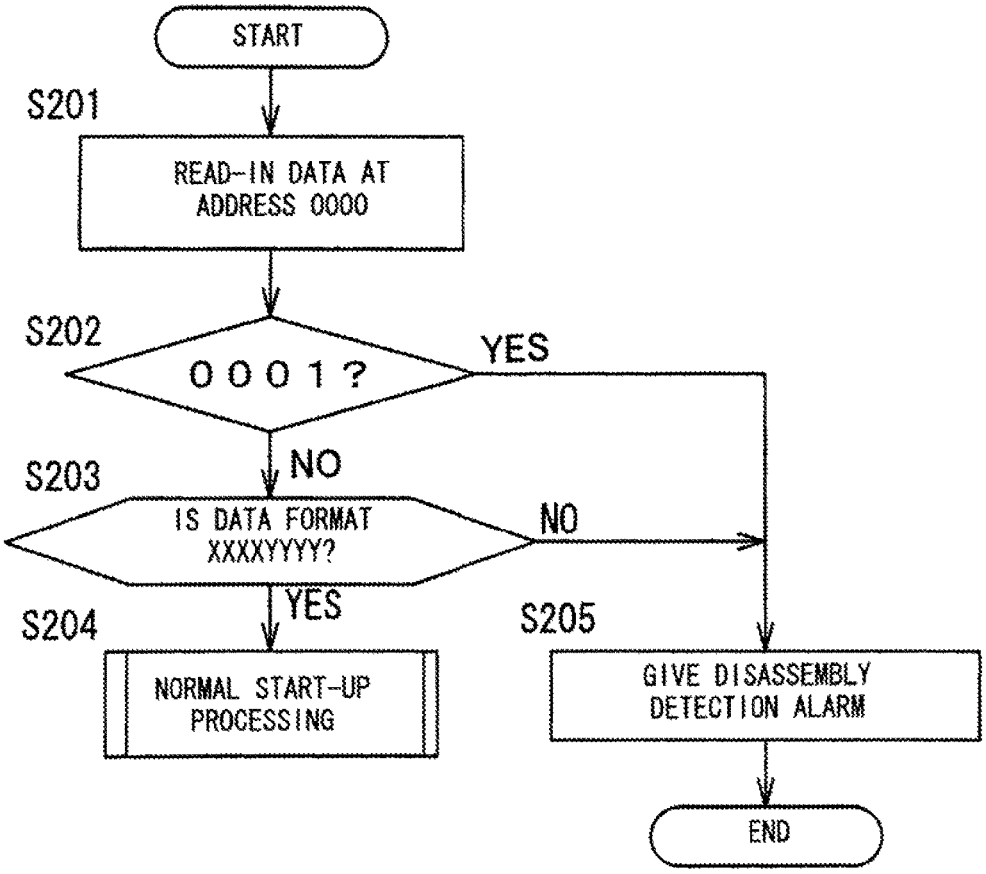
FIG. 8 presents a flowchart showing another example of a control of disassembly history confirmation.

FIG. 8 presents a flowchart showing another example of a disassembly history confirmation control upon pump start-up. Here, a case is shown in which it is configured that a serial number (S/N) is stored at address 0000 of the memory of the data storage unit 452, and when the turbomolecular pump is disassembled, the data stored at the address 0000 is changed from the serial number (S/N) to a value "0001". When the power supply of the control unit 30 is turned on, first in step S201, the main control unit 31 reads in the data stored at the address 0000. In step S202, the main control unit 31 determines whether or not the content of the data read in therein is a value "0001". If the determination in step S202 is affirmative, the main control unit 31 controls the process to proceed to step S205 without performing normal pump start-up action processing shown in step S204 and controls the alarm unit 34 to generate an alarm to notice that pump disassembly has occurred.

On the other hand, when the determination in step S202 is negative, the main control unit 31 controls the process to proceed to step S203 and determines whether the format of the read in data conforms to the data format of the serial number. The serial number is expressed by using X representing an alphabetical character and Y representing numerical character in a data format of, for example, XXXXYYYY. When it is determined that the data format of the data read-in in step S201 conforms to the data format of the serial number, the main control unit 31 controls the process to proceed from step S203 to step S204 to perform a normal pump start-up action processing. In step S203, when it is determined that the data format of the data read-in in step S201 does not conform to the data format of the serial number, the main control unit 31 controls the process to proceed to step S205.

Also in several variation examples mentioned above, the contents of the memory of the data storage unit 452 is changed, so that after the pump is assembled, an operation of writing in predetermined data for the recognition of disassembly similar to that in the above-mentioned embodiment is performed. When the disassembly detection switch 451 having the configuration shown in FIG. 7 is used, the power source 453 is substantially in an inactive state while the turbomolecular pump is operating normally without being disassembled. This is advantageous in that a battery cell used as the power source 453 may be a small size battery cell.

Note that it is necessary to adopt a configuration such that the user cannot read out the data stored in the data storage unit 452. For this purpose, it is preferred to adopt an authentication method in which authentication with a password is performed upon reading out the data. Further, the data stored in the data storage unit 452 by itself may be encrypted or an interlock may be used such that when for example, a calculated value obtained by a predetermined calculation using data stored at the address 0000 and data stored at the address 0001 coincides with a predetermined value, data is determined to be normal. By so doing, the data stored in the data storage unit 452 can be made more robust so that it cannot be read out by the user.

Figure 9:
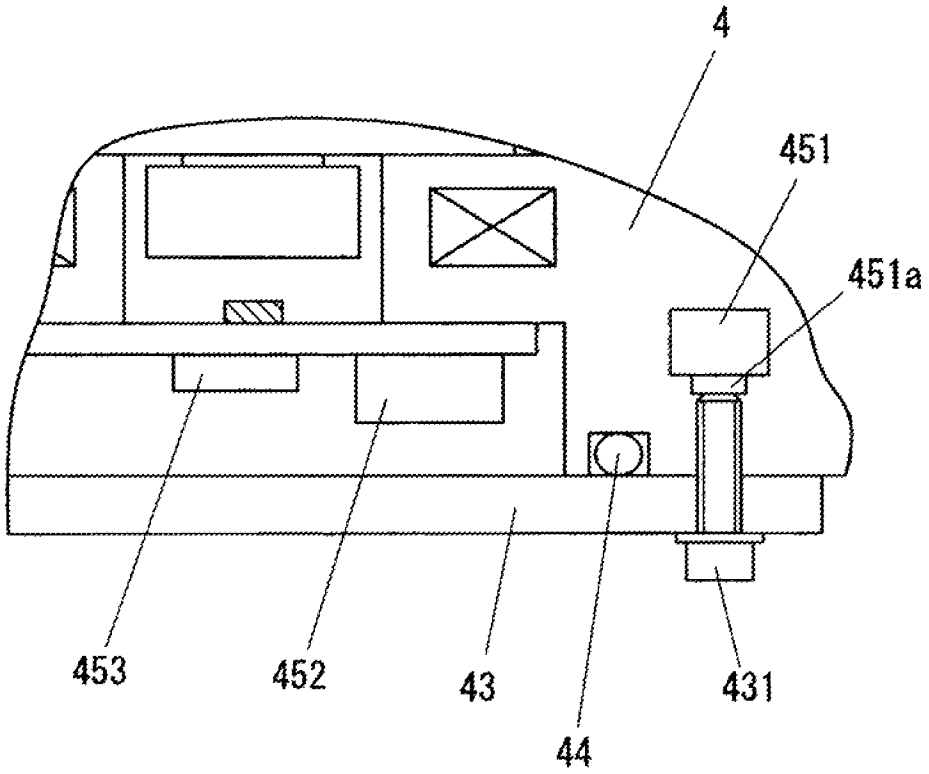
FIG. 9 presents a diagram showing another example of the pump disassembly detection structure.
Figure 10:
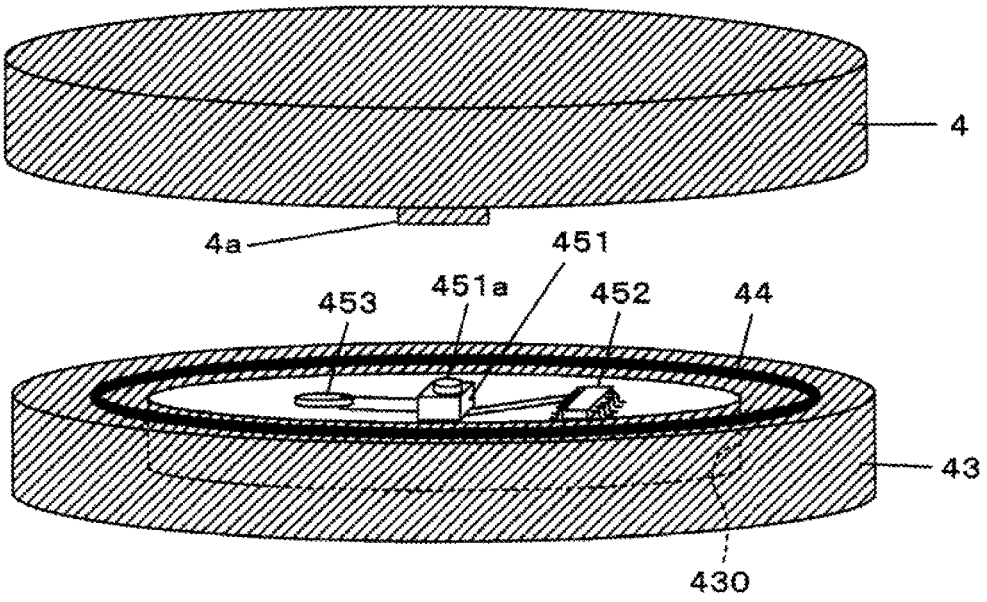
FIG. 10 presents a diagram showing another example of the pump disassembly detection structure.
Figure 11:
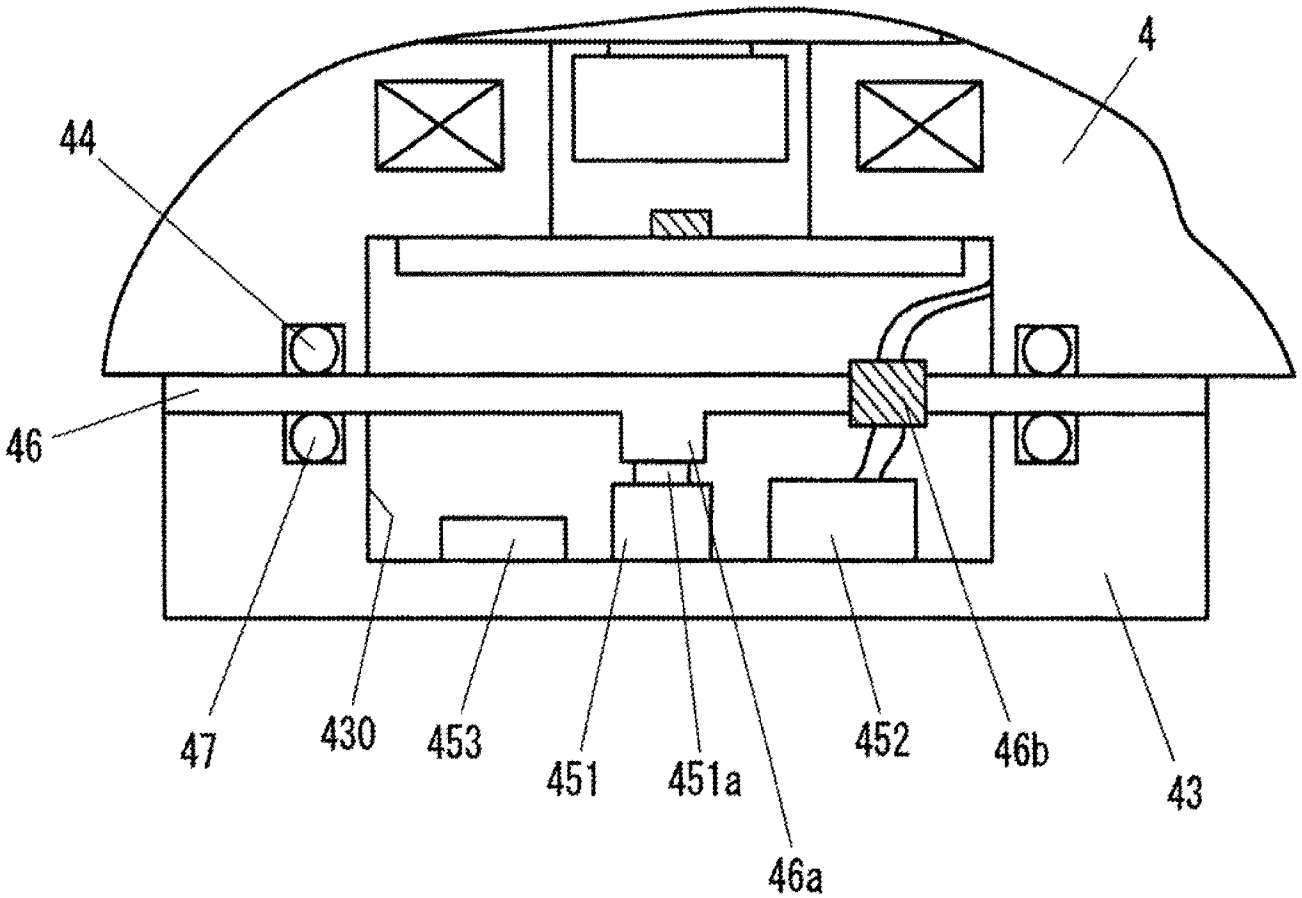
FIG. 11 presents a diagram showing another example of the pump disassembly detection structure.

Note that two types of configurations for detecting pump disassembly that use the mechanical disassembly detection switch 451 are shown in FIGS. 3 and 4. FIGS. 9 to 11 show other examples thereof. FIG. 9 shows a configuration that opens/closes the contact of the disassembly detection switch 451 by using bolts that fix members which must be detached upon pump disassembly.

In the configuration shown in FIG. 9, the bolts 431 that fix the back lid 43 to the base 4 are used. The disassembly detection switch 451 is provided at the bottom of the thread hole in the base 4, into which hole the bolt 431 is screwed. The push button 451*a* is arranged to be oriented toward the opening of the thread hole (downward in FIG. 9). Therefore, when the back lid 43 is fixed with the bolt 431, the push button 451*a* is pushed down by the tip of the bolt 431. When the bolt 431 is detached upon the pump disassembly, the push button 451*a* is changed into a state where it is not pushed. The same configuration as that of the bolt 431 may be applied to, for example, the bolt 14 that fixes the pump casing 13 shown in FIG. 4.

In another configuration shown in FIG. 10, the disassembly detection switch 451, the data storage unit 452 and the power source 453 that constitute the disassembly detection unit 45 are arranged on the back lid 43. In this case, a concave portion 430 is formed on the side of the inner surface of the back lid 43 and the above-mentioned components are arranged on the concave portion 430. A convex portion 4*a* for pushing the push button 451*a* of the disassembly detection switch 451 is provided on the side of the base 4. The configuration shown in FIG. 10 is advantageous in that if it is contemplated to maintain the state in which the push button 451*a* is pushed down upon pump disassembly, such an improper operation is difficult to occur since the tip of the push button 451*a* is sunk in the concave portion 430.

Instead of using the mechanical switch as mentioned above as the disassembly detection switch 451, the pump disassembly may be detected by using an optical switch, for example, a light sensor. For example, a light sensor such as a photo transistor or a photo diode is arranged in the inner space of the back lid 43 like the disassembly detection switch 451 shown in FIG. 3. When the back lid 43 is detached upon pump disassembly, light enters the light sensor, so that it can be detected that the back lid 43 has been detached. For deletion or overwriting of the back-up data after the detection of disassembly, processing similar to that in the case of the mechanical disassembly detection switch 451 is performed. Also, a proximity switch using infrared rays or a magnet may be used.

Another configuration shown in FIG. 11 corresponds to one in which a partition plate 46 is further provided between the back lid 43 and the base 4 shown in FIG. 10. The gap between the partition plate 46 and the base 4 is sealed with an O-ring 44 while the gap between the partition plate 46 and the back lid 43 is sealed with an O-ring 47. The partition plate 46 is formed of a convex portion 46*a* for pushing down the push button 451*a* of the disassembly detection switch 451. Also, the partition plate 46 is provided with a sealed type connector 46*b*, through which a data storage unit 452 and a pump connector 49 provided on an outer peripheral surface of the base in FIG. 1 are connected with each other.

With this structure, the space in the concave portion 430 of the back lid 43 and the inner space of the pump are shielded by the partition plate 46. For this reason, when corrosive gases are exhausted by the turbomolecular pump, the components that constitute the disassembly detection unit 45 can be prevented from being affected by the corrosive gases, so that detection of pump disassembly becomes more reliable.

—Second Embodiment—

In the case of the turbomolecular pump according to the first embodiment described above, after reassembly of the pump, predetermined data for the recognition of disassembly is written-in in the data storage unit 452 by using a dedicated device. In the case of the turbomolecular pump according to the second embodiment, it is configured such that the data storage unit 452 can be readily reset to its original state by the control unit after the pump is disassembled in order to reduce operations for bringing the pump into a state where it is ready for operation again.

Figure 12:
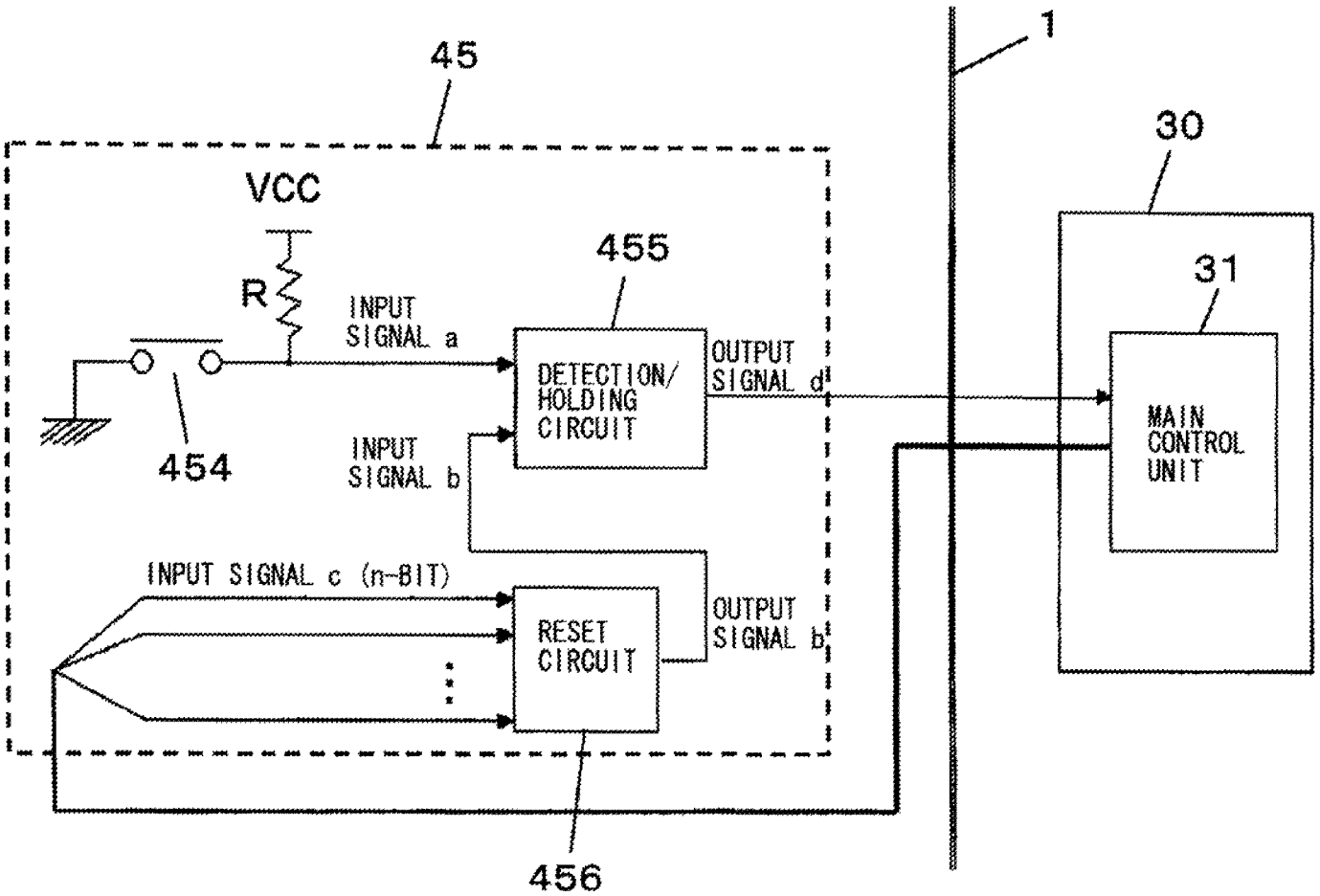
FIG. 12 presents a diagram showing a configuration of the disassembly detection unit according to a second embodiment.

FIG. 12 presents a diagram showing the configuration of the disassembly detection unit 45 according to the second embodiment. The disassembly detection unit 45 includes a switch 454, a detection/holding circuit 455, a reset circuit 456 and a pull-up resistor R. The disassembly detection unit 45 outputs an output signal a, which is input into the main control unit 31 of the control unit 30. An input signal c is an n-bit signal and the output signal a is a 1-bit signal. The control unit 30 reads the signal upon the start-up of the control unit 30 and determines whether or not the pump unit 1, which is connected to the control unit 30, is a pump that has a disassembly history. The switch 454 is configured such that it is maintained in a closed state when the pump is in an assembled state while it is brought into an open state when the pump is disassembled.

That is, when the pump is in an already assembled state, the switch 454 is always in a closed state and the input signal a takes a value of "0". When the pump is disassembled, the switch 454 is opened and voltage is pulled up by the pull-up resistor R, so that "1" is input as a value of the input signal a. When "1" is input as the value of the input signal a, the detection/holding circuit 455 retains this information and outputs "1" as the output signal d as described later. The state in which the output signal d has a value of "1" is not canceled but is retained even when the pump is assembled and the value of the input signal a returns to "0". That is, the disassembly history is held by the detection/holding circuit 455.

Figure 13:
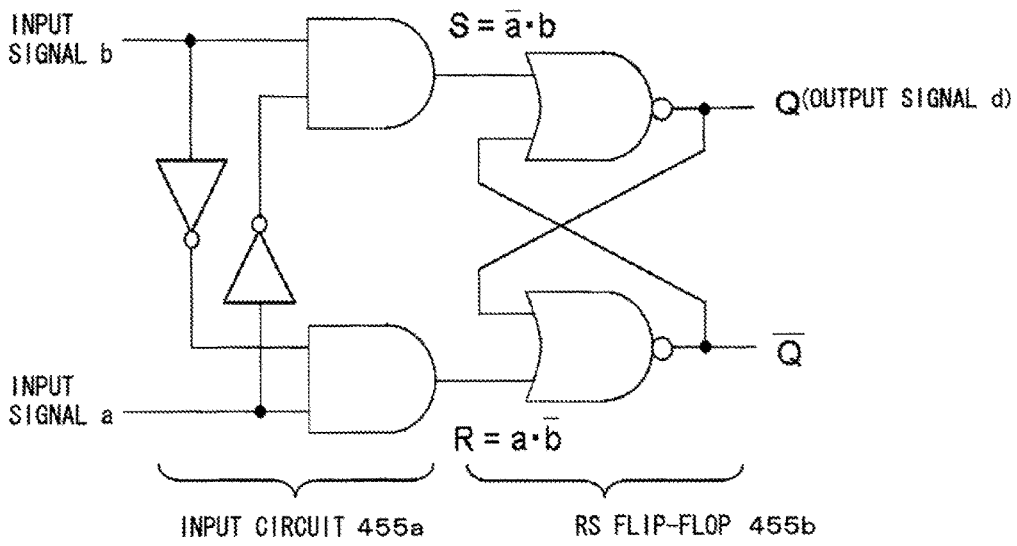
FIG. 13 presents a diagram showing an example of a detection/holding circuit.
Figures 15, 16:
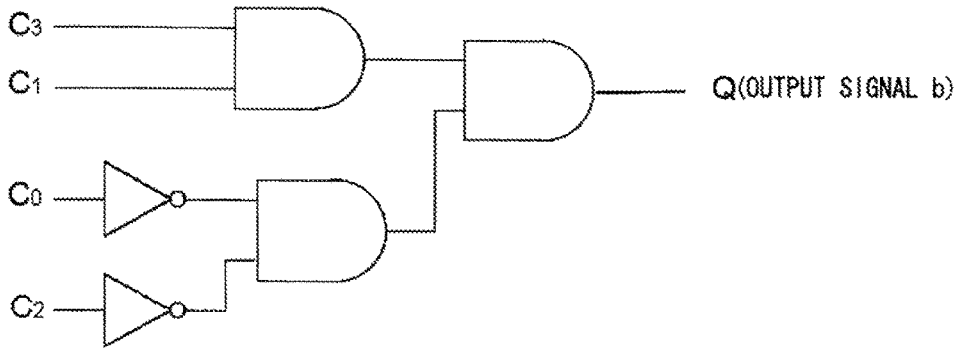
FIG. 15 presents a diagram showing an example of a reset circuit.
FIG. 16 presents a diagram showing a truth table of the reset circuit.

FIG. 13 presents a diagram showing an example of the detection/holding circuit 455 and FIG. 15 presents a diagram showing an example of the reset circuit 456. Note that these are shown only by way of examples and various configurations having the same function may be realized by using digital circuits.

In the detection/holding circuit 455 shown in FIG. 13, an RS flip-flop 455*b* is used in order to hold the input "1" as the input signal a. However, since it is prohibited that inputs of R=1 and S=1 are input to the RS flip-flop 455*b*, an input circuit 455*a* that converts the inputs of R=1 and S=1 into inputs of R=0 and S=0, respectively is provided upstream of the RS flip-flop 455*b*.

FIG. 14(*a*) shows a truth table of the detection/holding circuit 455 and FIG. 14(*b*) shows a state transition table of the detection/holding circuit 455. The input circuit 455*a* shown in FIG. 13 outputs the input signals as they are when the input signal (a,b) is (0,0), (0,1) or (1,0). For example, when the input signal (a,b) is (0,0) "0" is input to the R terminal of the RS flip-flop 455*b* and "0" is input to the S terminal of the RS flip-flop 455*b*. On the other hand, when the input signal (a,b) is (1, 1), the (1,1) is converted into (0,0) by the input circuit 455*a* and "0" is input to the S and R terminals, respectively.

As a result, as shown in FIG. 14(*a*), the output signal d from the Q terminal is not changed and the previous state is held when the input signal (a,b) is (0,0) or (1, 1). On the other hand, when the input signal (a,b) is (0,1), the output signal d has a value of "0" while when the input signal (a,b) is (1,0), the output signal d has a value of "1".

The state transition table shown in FIG. 14(*b*) illustrates how a present state Q(n) of the output signal d of the Q terminal will vary in response to 4 types of input signals (a,b). A state Q(n+1) shows a state after the 4 types of input signals (a,b) are input. When the input signals (a,b) are (0,0) and (1,1), the state is not changed so that Q(n+1)=Q(n) is obtained. On the other hand, when the input signal (a,b) is (0,1), the state is set to Q(n+1)=0 by the detection/holding circuit 455 regardless of whether or not the present state Q(n) is "1" or "0". On the contrary, when the input signal (a,b) is (1,0), the state is set by the detection/holding circuit 455 to Q(n+1)=1 independently of the present state Q(n).

FIG. 15 shows an example of the reset circuit 456 to which n-bit input signal c is input from the main control unit 31 in case of n=4. The reset circuit 456 outputs "1" as the value of the output signal b when only one signal is input out of n-th power of 2 kinds of signals that the n-bit input signal c can take. When the value "1" of the output signal b is input to the detection/holding circuit 455 as the value of the input signal b after the pump is assembled, the detection/holding circuit 455 is reset. Since the probability of the detection/holding circuit 455 being reset by chance when the user inputs a signal selected by him by a random guess is calculated to be one divided by n-th power of 2, it is desirable that the number of bits of the input signal c. i.e. the number of signal lines that extend from the main control unit 31 to the reset circuit 456 be increased.

FIG. 16 shows a truth table of the reset circuit 456 shown in FIG. 15. When a 4-bit input signal c is expressed by $c=C_3C_2C_1C_0$, the state Q that is output as the output signal b of the reset circuit 456 depending on the values of $C_3$, $C_2$, $C_1$ and $C_0$, is as shown in the truth table shown in, for example, FIG. 16. In this example, when the value of the input signal $c=C_3C_2C_1C_0$ is "1010", the output signal b has a value of "1" and in other cases the output signal b has a value of "0". The reset circuit 456 outputs "0" as the value of the output signal b usually when nothing is input.

When the turbomolecular pump is assembled by the manufacturer, after the pump is assembled, a signal with a signal value of "1010" is input as the input signal c from the main control unit 31 to the reset circuit 456, and the reset circuit 456 outputs "1" as a value of the output signal b. The output signal b is input to the detection/holding circuit 455 as the input signal b. On this occasion, the input signal a that is input to the detection/holding circuit 455 is "0" as mentioned above since the pump is in the assembled state. Therefore, as shown in FIG. 14(*a*), the output signal d from the Q terminal at this time has a value of "0". In this manner, the detection/holding circuit 455 is brought into a reset state. Thereafter, when the input of the input signal c from the main control unit 31 to the reset circuit 456 is stopped, the reset circuit 456 outputs "0" as the output signal b as described above since nothing is input to the reset circuit 456. The output signal b is input to the detection/holding circuit 455 as the input signal b. On this occasion, the input signal a to the detection/holding circuit 455 has a value of "0" since the pump is in the assembled state. That is, when the pump is shipped, both the input signals a, b of the detection/holding circuit 455 have a value of "0" and the output signal d has a value of "0". The output signal d having a value of "0" means that the state corresponding to the pump disassembly history held by the detection/holding circuit 455 is canceled.

On the other hand, when the pump is disassembled by the user, the switch 454 is opened and the voltage is pulled up by the pull-up resistor R, so that the value of the input signal a becomes "1". In this case, as shown in FIG. 14(*b*), the input signal ab of "10" whereas the present state Q(n) is "0", so that there is obtained Q(n+1)=1 and the value of the output signal d changes from "0" to "1". Thereafter, when the pump is reassembled, the switch 454 is closed and the value of the input signal a returns to "0". In this case, as shown in FIG. 14(*b*), the input signal ab of "00", whereas the present state Q(n) is "1", so that the state after the reassembly is held and there is obtained Q(n+1)=1.

That is, even when the value of the input signal a is changed from "1" to "0" by the reassembly of the pump after the disassembly thereof, the value of the output signal d of "1" is held as it is. In this manner, by providing the detection/holding circuit 455, once the pump is disassembled, the value of the output signal d is changed to "1". If the pump is assembled again, the output signal d=1 is retained. Accordingly, the output signal d indicates that the pump has been disassembled. That is, the detection/holding circuit 455 can hold the state that corresponds to the pump disassembly history as s value of the output signal d. Therefore, the main control unit 31 can determine that the detection/holding circuit 455 has detected the disassembled state of the pump by referring to the output signal d held by the detection/holding circuit 455.

Figure 17:
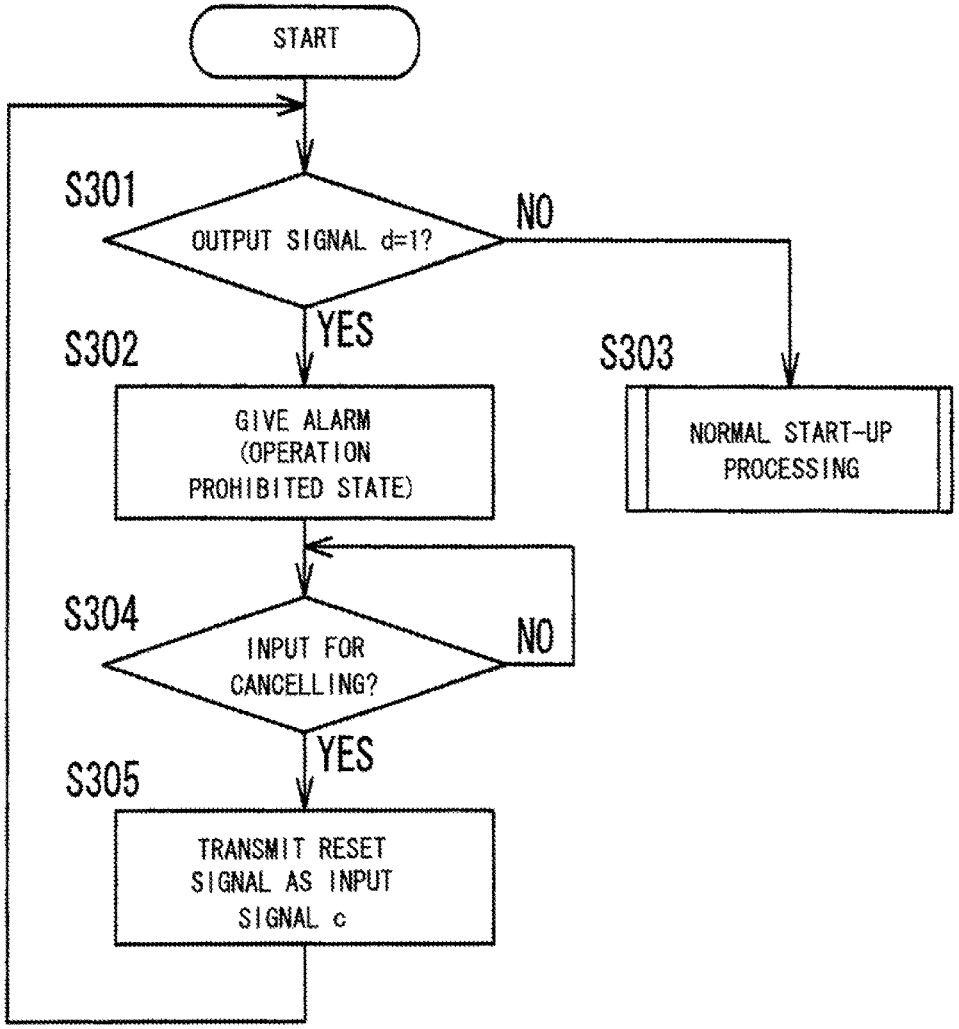
FIG. 17 presents a flowchart showing the action of the control unit at start-up.

Then, the action of the main control unit 31 of the control unit 30 when the pump unit 1 is connected to the control unit 30 is described referring to the flowchart shown in FIG. 17. The program for the processing shown in FIG. 17 starts when the control unit 30 is started up. In step S301, the main control unit 31 determines whether or not the output signal d from the pump unit satisfies d=1. When no pump disassembly history is present, the output signal d has a value of "0". Therefore, when the output signal d does not satisfy d=1, the main control unit 31 determines that the detection/holding circuit 455 has not detected the disassembled state of the pump. On this occasion, the main control unit 31 determines negatively in step S301 and controls the process to proceed to step S303. In step S303, a normal start-up action processing is performed.

On the other hand, when the determination in step S301 is affirmative, that is, when the main control unit 31 determines that the output signal d satisfies d=1, it controls the normal pump start-up action processing shown in step S303 to be not performed and controls the process to proceed to S302. In step S302, the main control unit 31 controls the alarm unit 34 to generate an alarm indicating that the start-up of the pump is impossible and the turbomolecular pump is brought into a state where its start-up is prohibited. In step S304, the main control unit 31 determines whether or not a cancel signal is input to the main control unit 31. The cancel signal is input from outside, for example, by an operator of the manufacturer of pump. Then, when the cancel signal is input, the main control unit 31 controls the process to proceed from step S304 to step S305, where the reset signal described above is input to the reset circuit 456 in the pump unit 1 as the input signal c. The cancel signal may be the above-mentioned reset signal itself. In case that the cancel signal or the reset signal that is equivalent to the cancel signal is not input from outside the main control unit 31, the reset signal is not input to the reset circuit 456. When the processing in step S305 is completed, the process is returned to step S301.

Since usually, the cancel signal is unknown to the user, the user cannot cancel the state in which operation of the pump is prohibited. As a result, the operation of the pump in an unreliable state where the pump has been disassembled by the user can be prevented, so that safety in the operation of the pump is secured. When such a state is established where operation of the pump is prohibited, an operator of the manufacturer or an operator licensed by the manufacturer confirms the state of the pump before he can perform an operation of cancelling the pump operation prohibited state. The cancel operation is to simply input a cancel signal to the main control unit 31 of the control unit 30 by the operator and no special device or jig is necessary for cancelling, so that the workability of cancel operation can be improved. The cancel signal is input by operation of an input device such as a push button provided in the control unit 30 by the operator.

Note that if both the cancel signal and the reset signal mentioned above are grasped and managed only by the operator who is licensed by the manufacturer of the turbomolecular pump, it is avoided that the pump that has been disassembled and reassembled by an operator other than a person who is licensed by the manufacturer of the pump is operated, so that safety of the pump being operated is secured.

—Third Embodiment—

The above mentioned embodiment is an, embodiment in which the pump unit 1 and the control unit 30 are provided separately. In contrast, a turbomolecular pump according to a third embodiment in which the pump unit and the control unit are integrally configured is explained below.

Figure 18:
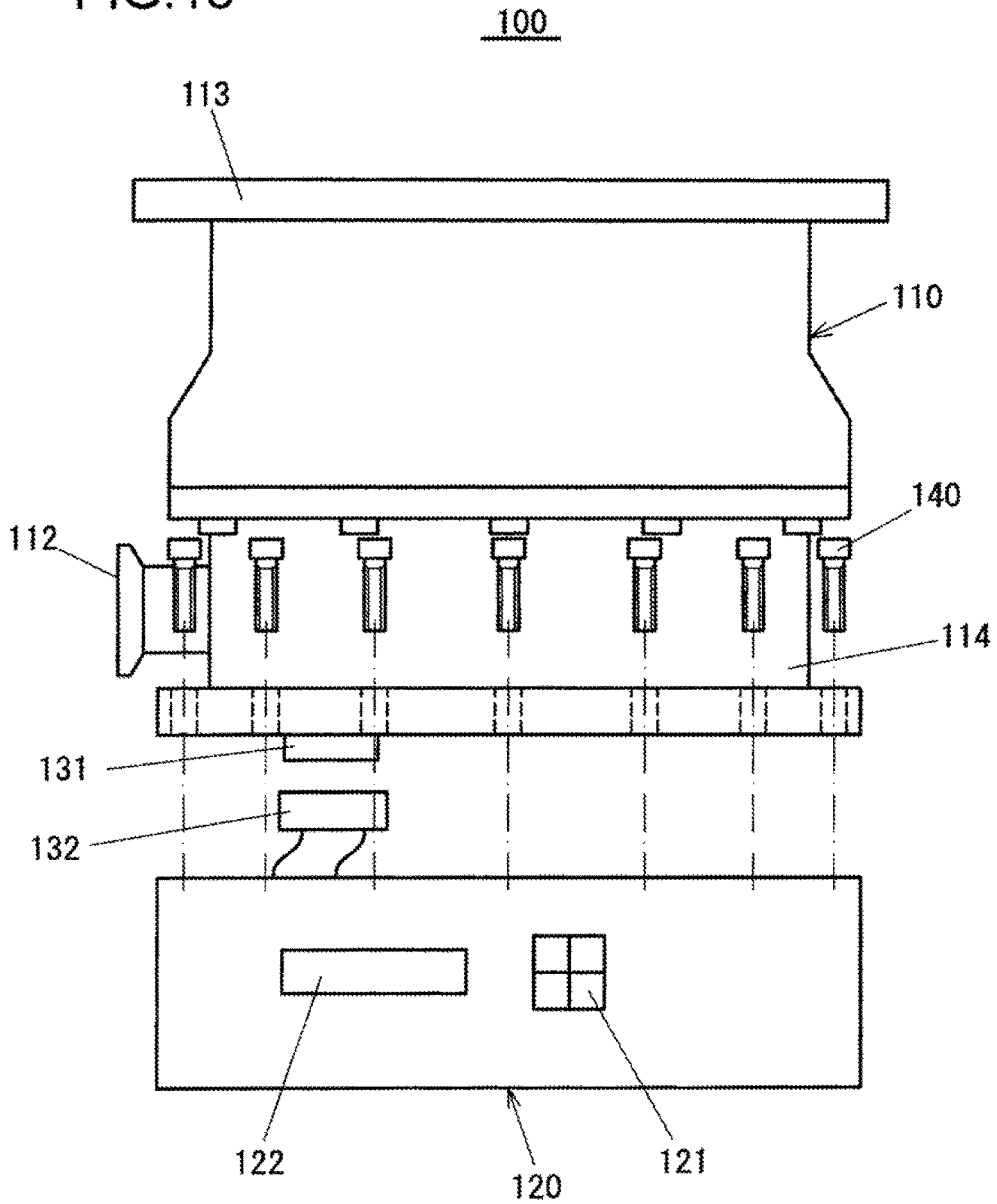
FIG. 18 presents a diagram illustrating a third embodiment.

FIG. 18 presents a diagram explaining the turbomolecular pump according to the third embodiment, showing the whole appearance of the turbomolecular pump. The turbomolecular pump 100 includes a pump unit 110 and a control unit 120. By fixing the pump unit 110 to the upper surface of the control unit 120 with bolts, the pump unit 110 and the control unit 120 are integrated to each other. FIG. 18 shows a state in which bolts 140 for fixation are detached and the pump unit 110 and the control unit 120 are separated from each other.

The pump unit 110 has the same configuration as that of the pump unit 1 shown in FIG. 1 and has a base 114 and a casing 113. The configuration of the control unit 120 is similar to that of the control unit 30 shown in FIG. 1. The base 114 of the pump unit 110 is provided with an exhaust port 112 to which a back pump is to be connected. Electrical connection between the pump unit 110 and the control unit 120 is established by connecting a connector 131 provided on the side of the bottom of the pump unit 110 to a connector 132 provided on the top of the control unit 120. The control unit 120 is provided with a display unit 122 that displays a state of operation and the like and a switch 121 that performs on/off of power supply and other operations.

In performing the maintenance of the pump unit 110, upon separation of the pump unit 110 from the control unit 120, the bolts 140 are detached as shown in FIG. 18 and the connectors 131 and 132 are separated to separate the pump unit 110 and the control unit 120 from each other. Thereafter, the disassembly operation of the pump unit 110 is performed. For this purpose, in the present embodiment, the disassembly detection switch 451 shown in FIG. 2 is provided between the pump unit 110 and the control unit 120. In this manner, the disassembly detection switch 451 detects separation of the pump unit 110 and the control unit 120 from each other when the connectors 131 and 132 are separated from each other. As the disassembly detection switch 451, the mechanical switch and the light sensor described in the first embodiment may be used in the same manner as in the first embodiment.

Figure 19:
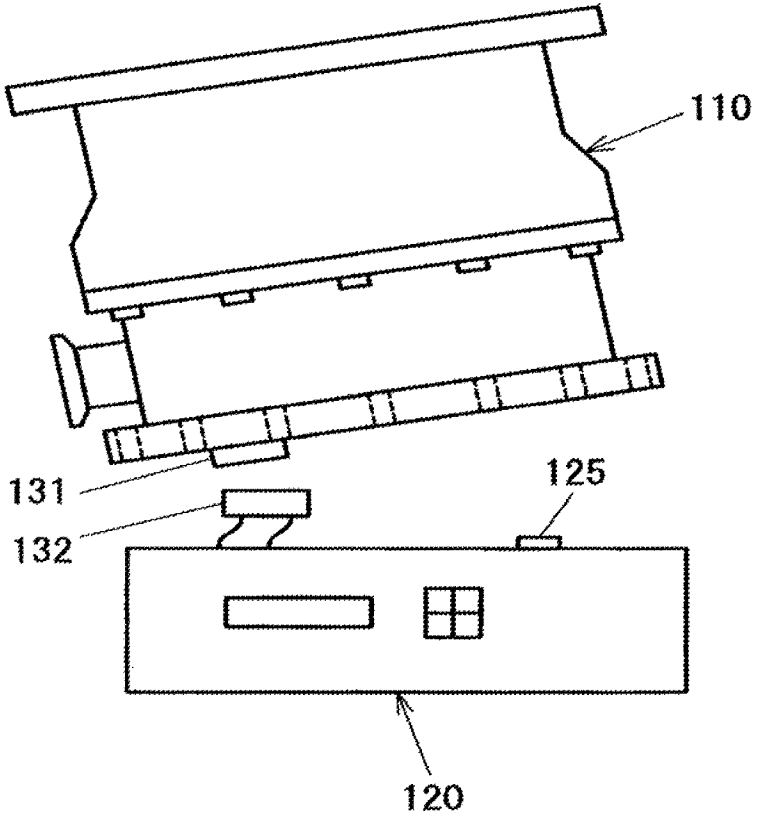
FIG. 19 presents a diagram showing an example of and an alternative example of the disassembly detection switch.
Figure 19:
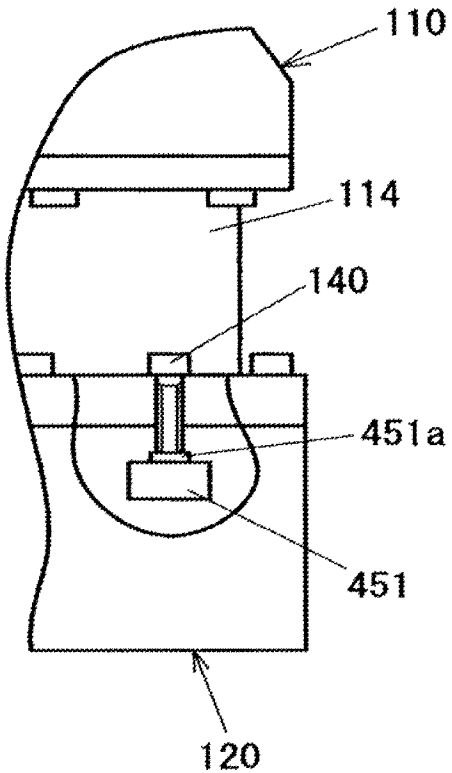

FIG. 19 shows an example of the disassembly detection switch 451 and an alternative example therefor. The disassembly detection switch 451 shown in FIG. 19(*a*) has the same configuration as that shown in FIG. 9 and is configured such that the disassembly detection switch 451 can be turned on/off by using bolts 140 for fixing the pump unit 110 to the control unit 120. When the pump unit 110 and the control unit 120 are integrated with the bolts 140, the push button 451*a* of the disassembly detection switch 451 is pushed by the tip of the bolt 140 and the disassembly detection switch 451 is brought into a closed state. On the other hand, when the bolt 140 is detached, the push button 451*a* that has been pushed down protrudes to bring the disassembly detection switch 451 into an open state.

In the example shown in FIG. 19(*b*), a light sensor 125 is used instead of the disassembly detection switch 451 and the light sensor 125 detects that the pump unit 110 is separated from the control unit 120. When the pump unit 110 and the control unit 120 are separated from each other, the light sensor 125 provided on the top of the control unit 120 is exposed and light enters into the light sensor 125. The light sensor 125 detects whether or not the pump unit 110 and the control unit 120 are separated from each other depending on whether or not light enters into the light sensor 125.

Figure 20:
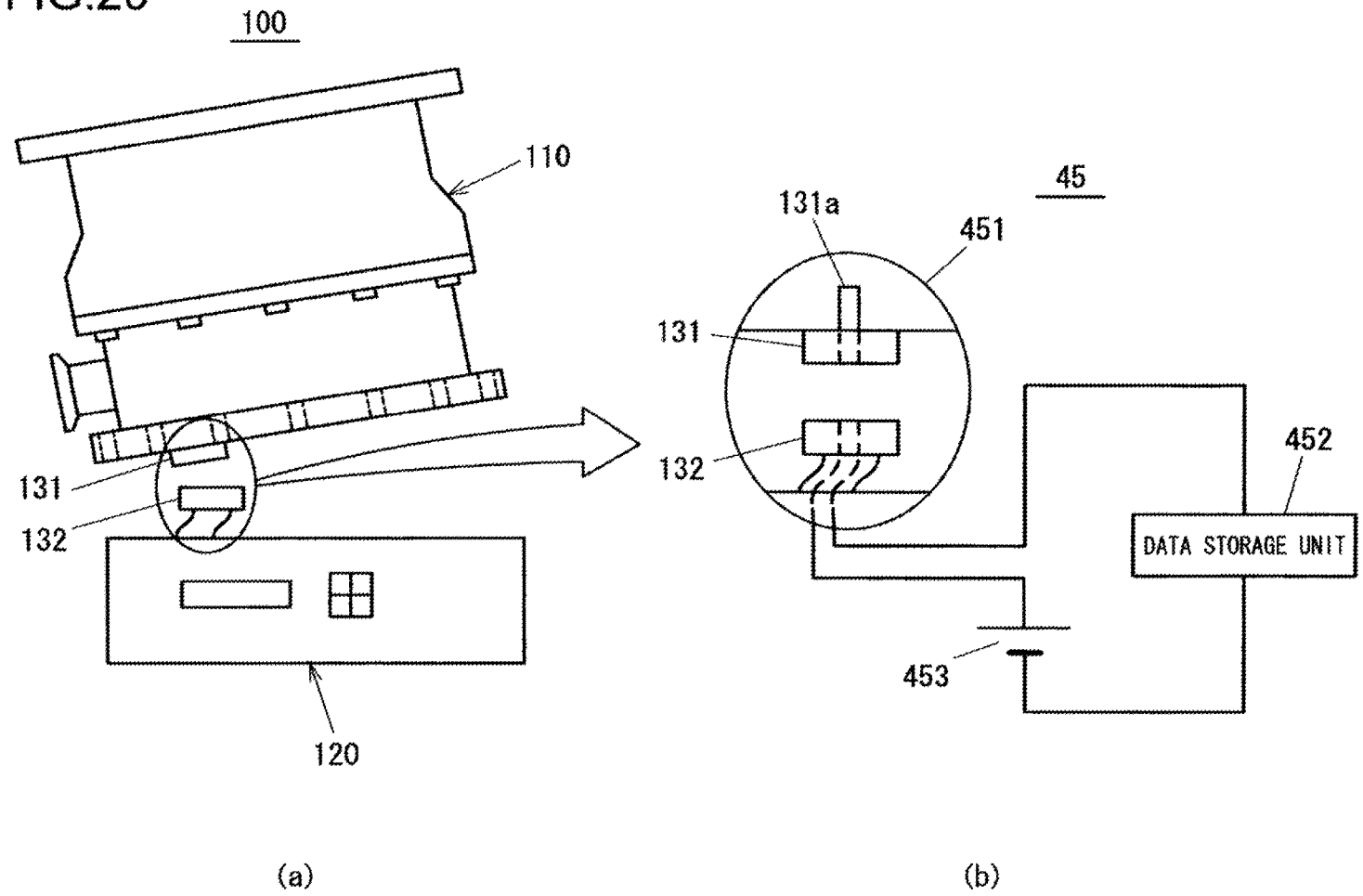
FIG. 20 presents a diagram showing another configuration of the disassembly detection switch.

FIG. 20 presents a diagram showing another configuration of the disassembly detection switch 451. The disassembly detection switch 451 detects the separation, of the pump unit 110 by using the connectors 131 and 132, FIG. 20(*a*) presents a diagram showing the turbomolecular pump 100 in whole that has been brought into a separated state and FIG. 20(*b*) presents a block diagram showing the configuration of the disassembly detection unit 45. In the turbomolecular pump according the present embodiment, the data storage unit 452 and the power source 453 for holding data of the disassembly detection unit 45 are provided in the control unit 120. However, they may be provided in the pump unit 110 similarly to the turbomolecular pump according to the first embodiment. The block diagram shown in FIG. 20(*b*) has the same configuration as that shown in the block diagram shown in FIG. 2. However, the block diagram shown in FIG. 20(*b*) is different from that of the block diagram shown in FIG. 2 in that the connectors 131 and 132 are used in the disassembly detection switch 451.

The circuit of the disassembly detection unit 45 is configured so that it passes through the connectors 131 and 132. A portion of the circuit is connected to a pair of pins included in the connector 132. The pair of pins is fitted into a pair of pins included in the connector 131. The pair of pins included in the connector 131 is connected to each other by a wire 131*a*. As a result, if the connectors 131 and 132 are connected to each other, the circuit is closed whereas the circuit is opened when the connector 131 and the connector 132 are separated from each other. That is, the connectors 131 and 132 function as a disassembly detection switch 45. In this case, it is unnecessary to add a new switch as the disassembly detection switch 451, so that an increase in cost can be suppressed.

Note that also in the third embodiment, the configurations described in the first and the second embodiments may be made use of as the configuration for holding the disassembly history or the configuration for performing cancelling. When the configuration described in the first embodiment is applied to the third embodiment, for example, when the power supply to the control unit 120 is turned on, the main control unit of the control unit 120 reads in the back-up data stored in the data storage unit 452. The main control unit determines whether or not the pump has been disassembled, that is, whether or not a disassembly history is present based on the read-in back-up data. It is configured such that the power supply from the power source 453 to the data storage unit 452 is stopped due the pump disassembly so that the back-up data stored by data storage unit is deleted. That is, when a disassembly history is present, no back-up data is present in the data storage unit 452, so that the main control unit reads in indefinite data held in the data storage unit 452. The indefinite data is data that indicates that the state in which a disassembly history is present is held by the data storage unit 452 and usually does not coincide with the predetermined data for the recognition of disassembly stored in the memory of the main control unit. The main control unit determines whether or not the pump has been disassembled based on whether or not the data for the recognition of disassembly that is read in from the data storage unit 452 coincides with the data for the recognition of disassembly stored by the main control unit. When the main control unit determines that there is a disassembly history, the main control unit controls the alarm unit to generate an alarm to notice that there has been disassembly of the pump, with prohibiting the normal pump start-up action processing to be performed. The main control unit performs a normal pump start-up action processing when it determines that no disassembly history is present.

Note that the disassembly detection unit 45 according to the third embodiment may have a circuit configuration of the disassembly detection unit 45 according to the second embodiment shown in FIG. 12. In that case, the connectors 131 and 132 function as the switch 454.

As in the present embodiment, in the case of all-in-one turbomolecular pump, upon pump disassembly, separation of the pump unit 110 and the control unit 120 from each other is performed without fail. Therefore, detection of such separation makes it possible to detect whether or not the pump has been disassembled. When non-normal pump disassembly has been performed, the state of the pump is confirmed by an operator from the manufacturer of the pump and subsequently the disassembly history is canceled, so that operation of the pump after its reassembly becomes possible.

As mentioned above, according to the present invention, a vacuum pump that performs evacuation by rotating a rotor that is formed of an evacuation function unit, for example, a turbomolecular pump in which a rotor 2 formed of rotary blades 8 is rotated at high speeds or a drag pump in which a rotor formed of threaded groove type exhaustion passage is rotated at high speeds, has the following configuration. That is, the vacuum pump has the disassembly detection unit 45 as a pump disassembly detection circuit that detects, upon pump disassembly, a change from an assembled state in which components of the vacuum pump such as the back lid 43, the pump casing 13, and connectors 131 and 132 in the case of all-in-one pump and the like have been assembled to a non-assembled state in which, the vacuum pump has been disassembled into the components thereof. The vacuum pump has the main control unit 31 of the control unit 30 as a pump operation prohibition circuit that prohibits the rotary drive of the rotor 2 when a non-assembled state is detected by the disassembly detection unit 45. With such a configuration of the vacuum pump, the operation of the pump is prohibited when there has been an improper pump disassembly, so that the safety of the vacuum pump can be secured.

The above-mentioned embodiments may be used singly or in combinations. When each of the embodiments is used alone, the embodiments can exhibit their respective advantageous effects and when the embodiments are used in combinations, they can exhibit a synergistic effect by the combined use. As far as the features of the present invention are not damaged, the present invention is not limited to the above-mentioned embodiments. For example, in the above-mentioned embodiments, magnetic bearing-supported type turbomolecular pumps are explained as the vacuum pumps.

However, the vacuum pump that can be used in the embodiments of the present invention is not limited to the magnetic bearing-supported type vacuum pump. For example, a vacuum pump such as a drag pump may be used.

Although various embodiments and variation examples have been explained as above, the present invention is not limited to the contents of the above description.

The disclosure of the following basic application to which priority is claimed in this application is incorporated herein by reference.

Japanese Patent Application No. 2010-281909 (filed on Dec. 17, 2010).

The invention claimed is:

1. A vacuum pump comprising:

a rotor that is rotated to perform evacuation;

a pump disassembly detection circuit that detects a disassembled state in which the vacuum pump is disassembled;

a pump operation prohibition circuit that prohibits rotary drive of the rotor when the pump operation prohibition circuit determines that the pump disassembly detection circuit has detected the disassembled state;

a pump unit that includes the rotor and performs evacuation; and a control unit that performs drive control of the pump unit including the rotary drive of the rotor, wherein the pump unit includes the pump disassembly detection circuit and a holding circuit that holds data for recognition of a disassembly history when the pump disassembly detection circuit has detected the disassembled state, the control unit includes the pump operation prohibition circuit, and the pump operation prohibition circuit determines that in a case where the data for recognition of the disassembly history is held by the holding circuit at start-up of the control unit, the pump disassembly detection circuit has detected the disassembled state, and prohibits the drive control of the pump unit by the control unit, wherein the pump unit includes a magnetic bearing that magnetically levitates the rotor, the case where the state corresponding to the data for the recognition of the disassembly history is held by the holding circuit at start-up of the control unit is a case where other data that is different from a value of a magnetic bearing control parameter with which the magnetic bearing magnetically levitates the rotor is held by the holding circuit, the pump operation prohibition circuit determines that when the other data held by the holding circuit and the value of the magnetic bearing control parameter that is input into the control unit in advance do not coincide with each other, the pump disassembly detection circuit has detected the disassembled state and prohibits the drive control of the pump unit by the control unit, and the holding circuit stores in advance the value of the magnetic bearing control parameter and replaces the value of the magnetic bearing control parameter that is stored in advance by the other data when the pump disassembly detection unit has detected the disassembled state.

2. The vacuum pump according to claim 1, wherein the control unit includes an input unit that inputs a cancel command for canceling the data for recognition of the disassembly history held by the holding circuit, and the pump unit includes a reset circuit that resets the data for recognition of the disassembly history held by the holding circuit when the cancel command is input therein by the control unit.

3. The vacuum pump according to claim 1, further comprising:

an alarm device that generates an alarm when the pump operation prohibition circuit determines that the pump disassembly detection circuit has detected the disassembled state.

4. A vacuum pump which integrates a control unit thereto, comprising:

a rotor that is rotated to perform evacuation;

a pump disassembly detection circuit that detects a disassembled state in which the vacuum pump is disassembled;

a pump unit that includes the rotor and performs evacuation; and a control unit that is separably fixed to the pump unit, is integrated to the pump unit and performs drive control of the pump unit including the rotary drive of the rotor, wherein the pump disassembly detection circuit detects the disassembled state when the control unit is separated from the pump unit; and the control unit prohibits rotary drive of the rotor when the control unit determines that the pump disassembly detection circuit has detected the disassembled state.

5. The vacuum pump according to claim 4, wherein the pump unit and the control unit each include a connector that electrically connects the pump unit and the control unit with each other, and the pump disassembly detection circuit detects the disassembled state when the connector is separated upon separation of the control unit from the pump unit.

* * * * *